US009222353B2

(12) United States Patent
Morris et al.

(10) Patent No.: US 9,222,353 B2
(45) Date of Patent: Dec. 29, 2015

(54) TIP FOR AN EARTH WORKING ROLL

(75) Inventors: Ray J. Morris, Portland, OR (US); Christopher M. Carpenter, Tualatin, OR (US); Robert S. Fleck, Wilsonville, OR (US); Mark A. Cheyne, Portland, OR (US)

(73) Assignee: ESCO Corporation, Portland, OR (US)

( * ) Notice: Subject to any disclaimer, the term of this patent is extended or adjusted under 35 U.S.C. 154(b) by 347 days.

(21) Appl. No.: 12/350,634

(22) Filed: Jan. 8, 2009

(65) Prior Publication Data

US 2009/0174252 A1 Jul. 9, 2009

Related U.S. Application Data

(60) Provisional application No. 61/019,742, filed on Jan. 8, 2008, provisional application No. 61/075,253, filed on Jun. 24, 2008.

(51) Int. Cl.

| | |
|---|---|
| ***B02C 13/28*** | (2006.01) |
| ***E21C 35/193*** | (2006.01) |
| *E21C 35/18* | (2006.01) |

(52) U.S. Cl.

CPC ..... *E21C 35/1933* (2013.01); *E21C 2035/1806* (2013.01)

(58) Field of Classification Search

USPC ..... 299/112 T, 112 R, 113, 108, 109, 79.1, 299/82.1, 83.1, 84.1, 100–105; 37/453, 37/452, 454, 455, 456, 450; 403/379.2, 403/379.3, 374.3; 172/719, 753, 772.5; 144/24.12, 61, 46, 47, 48, 101, 102; 241/300, 197, 294; 407/102, 118

See application file for complete search history.

(56) References Cited

U.S. PATENT DOCUMENTS

| | | | | | |
|---|---|---|---|---|---|
| 1,288,482 | A | | 12/1918 | Biggs | |
| 1,538,831 | A | * | 5/1925 | Lucas | 241/197 |
| 1,804,756 | A | * | 5/1931 | Elwood | 37/456 |
| 2,397,521 | A | * | 4/1946 | Askue | 37/456 |
| 2,534,301 | A | * | 12/1950 | Sennholtz | 241/197 |
| 2,853,283 | A | * | 9/1958 | Cook | 299/103 |
| 2,867,137 | A | * | 1/1959 | Joy | 76/115 |
| 2,907,559 | A | * | 10/1959 | Brown et al. | 299/109 |
| 3,331,637 | A | | 7/1967 | Krekeler | |

(Continued)

FOREIGN PATENT DOCUMENTS

| | | | |
|---|---|---|---|
| DE | 2022558 | | 11/1971 |
| GB | 2067625 | A * | 7/1981 |

(Continued)

OTHER PUBLICATIONS

Kennametal, The Mining Tool Authority, Cutting and Drilling Systems, Copyright 2000 by Kennametal Inc., Latrobe, PA; pp. 4, 6, 16-23, 36-37, 41, 43, 47 and 66-67.

*Primary Examiner* — Sunil Singh
(74) *Attorney, Agent, or Firm* — Steven P. Schad

(57) ABSTRACT

A tip for use on an earth working roll for mining, construction and public works machines such as crushers, surface miners, milling machines and the like includes a working end provided with side relief to reduce drag and wearing, require less power to drive the rolls, and lengthen the usable life of the tip. The working end can also have a generally flat front surface to improve the yield in a crushing or other similar operation. The tip includes a base and a wear cap releasably secured together by a retainer.

24 Claims, 28 Drawing Sheets

(56) References Cited

U.S. PATENT DOCUMENTS

| | | | | | |
|---|---|---|---|---|---|
| 3,397,012 | A | | 8/1968 | Krekeler | |
| 3,510,076 | A | * | 5/1970 | Perdue | 241/197 |
| 3,512,284 | A | * | 5/1970 | Haynes | 37/447 |
| 3,544,166 | A | * | 12/1970 | Proctor | 299/81.1 |
| 3,624,827 | A | | 11/1971 | Liess et al. | |
| 3,830,321 | A | | 8/1974 | McKenry et al. | |
| 3,865,437 | A | | 2/1975 | Crosby | |
| 3,917,361 | A | | 11/1975 | Murdoch | |
| 3,932,952 | A | | 1/1976 | Helton et al. | |
| RE28,900 | E | | 7/1976 | Byers et al. | |
| 4,084,856 | A | | 4/1978 | Emmerich et al. | |
| 4,202,504 | A | * | 5/1980 | Cameron | 241/194 |
| 4,266,622 | A | | 5/1981 | Vezirian | |
| 4,326,348 | A | * | 4/1982 | Emrich | 37/453 |
| 4,428,131 | A | * | 1/1984 | Hahn | 37/453 |
| 4,587,751 | A | * | 5/1986 | Sjogren et al. | 37/453 |
| 4,725,098 | A | | 2/1988 | Beach | |
| 4,826,090 | A | | 5/1989 | Orphall | |
| 4,924,609 | A | | 5/1990 | Martin | |
| 5,100,070 | A | * | 3/1992 | Montgomery, Sr. | 241/294 |
| 5,261,499 | A | | 11/1993 | Grubb | |
| 5,400,861 | A | | 3/1995 | Sheirer | |
| 5,730,502 | A | | 3/1998 | Montgomery et al. | |
| 5,833,017 | A | | 11/1998 | Woods et al. | |
| 5,927,411 | A | | 7/1999 | Sheirer | |
| 5,956,874 | A | * | 9/1999 | Ianello et al. | 37/456 |
| 6,024,143 | A | * | 2/2000 | Ritchey | 144/24.12 |
| 6,129,422 | A | | 10/2000 | Siddle et al. | |
| 6,145,606 | A | | 11/2000 | Haga | |
| 6,176,552 | B1 | | 1/2001 | Topka, Jr. et al. | |
| 6,220,671 | B1 | | 4/2001 | Montgomery et al. | |
| 6,244,665 | B1 | | 6/2001 | Bise et al. | |
| 6,430,851 | B1 | | 8/2002 | Clendenning | |
| 6,478,383 | B1 | | 11/2002 | Ojanen et al. | |
| RE38,151 | E | | 6/2003 | Penkunas et al. | |
| 6,574,527 | B1 | | 6/2003 | Courtney et al. | |
| D487,753 | S | | 3/2004 | Brady | |
| 6,786,557 | B2 | | 9/2004 | Montgomery et al. | |
| 6,824,225 | B2 | | 11/2004 | Stiffler | |
| 6,851,758 | B2 | | 2/2005 | Beach | |
| 6,886,645 | B2 | | 5/2005 | Bise et al. | |
| 7,036,890 | B2 | | 5/2006 | Hill et al. | |
| 7,730,651 | B2 | * | 6/2010 | Carpenter | 37/452 |
| 2003/0099514 | A1 | | 5/2003 | Livesay et al. | |
| 2007/0193075 | A1 | | 8/2007 | Carpenter | |
| 2007/0227051 | A1 | | 10/2007 | Carpenter | |

FOREIGN PATENT DOCUMENTS

| | | |
|---|---|---|
| GB | 2127463 | 4/1984 |
| JP | S43 25795 | 10/1968 |
| JP | 53-65233 | 11/1976 |
| JP | 56-121766 | 2/1980 |
| JP | H2 023062 | 2/1990 |
| JP | 11319595 | 11/1999 |
| JP | 11319596 | 11/1999 |
| WO | WO2006 119536 | 11/2006 |

* cited by examiner

TIP FOR AN EARTH WORKING ROLL

FIELD OF THE INVENTION

The present invention pertains to a tip for an earth-working roll such as used in a roll crusher, surface miner, underground mining machines, milling machine and the like.

BACKGROUND OF THE INVENTION

A number of machines involved in mining, construction and public works use rolls that are driven for the crushing, mining, milling and the like of earthen materials. These earth working rolls include an array of tips to engage the material to be worked. The tips are releasably secured to holders attached to the roll at various locations. The tips are wear parts that are replaced after a certain length of use.

As one example, earth working tips can be provided in a roll crusher for the crushing of earthen material in a mining operation. In a typical operation (FIG. 53), the mined material 1 is dumped into a chute 3 and directed onto a conveyor 5 for transport to a roll crusher 7. The roll crusher 7 is a double roll crusher, which includes a pair of opposed rolls 9 to break up the mined material 1. Each roll 9 is fitted with an array of tips 11 adapted to engage the mined material and break it up (FIG. 54). The tips are secured to holders 13 that are fixed to the rolls 9. The rolls 9 are rotated in opposite directions so that the tips 11 are driven toward each other from the top. The broken material 1A passing through the roll crusher 7 is deposited on a second conveyor 17 for transport to rotary screens 19 for separation of the material.

Tip 11 is a one-piece member that includes a mounting shaft 21 for attachment to a holder 13, and a cone 23 for engaging the mined material 1 (FIGS. 55-57). Cone 23 has a conical exterior 25 with a rounded front end 27 corresponding to a generally spherical segment. The driving of the cone through the material in a conventional tip 11 imposes a substantial drag on the rotation of the roll as the earthen material drags along a full one half of the cone's large periphery. The use of many cones on a roll multiplies the drag such that high power requirement are needed to drive the rolls.

Mounting shaft 21 has a stepped configuration for a mating fit into a hole in holder 13, and a securing groove 31 into which the free end of a screw threaded into the holder is received to permit rotation of the cone during use. On account of the shape of the cones and its intended rotation, hardfacing 29 is applied over the entire cone 23. A double layer of hardfacing is applied over the leading portion 23A of the cone to extend the usable life of the tip. Hardfacing, however, is expensive and adds considerably to the overall cost of the tip.

The tip's shaft and the wall of the hole in the holder receiving the shaft are machined and close fitting to provide sufficient support for the tip. Even so, due to the invasiveness of earthen fines and the chaotic nature of a crushing or mining operation, fines commonly get embedded in the hole around the shaft. These fines tend to restrict and oftentimes prevent the rotation that is intended for the tip, thus, nullifying the potential gain of even wearing. Moreover, the presence of fines in the holder around the shaft can make the tip difficult to remove from the holder.

SUMMARY OF THE INVENTION

The present invention pertains to an improved tip for use on an earth working roll for mining, construction and public works machines such as crushers, surface miners, underground mining machines, milling machines and the like.

In accordance with one aspect of the invention, the tip comprises two components secured together by a retainer. One component is a base that is secured to a holder, and the other component is a wear cap that engages the earthen material. The wear cap sets over the base and contacts the earthen material for crushing, mining, etc. As a result, the wear cap wears out well before the base. With this construction, only the wear cap needs to be replaced, and successive wear caps can be mounted onto the same base. This results in less material being discarded and an easier change out process.

In accordance with other aspects of the invention, the tip is defined as a wear cap with a cavity that mounts over a protruding seat defined by the holder. In this arrangement, the need for an integral or separate base for the tip is eliminated. Since much less material is needed, manufacturing cost and storage requirements for the tips are reduced. Moreover, as with the two piece tips, the use of a tip formed solely as a wear cap means less material is discarded and the tips can be replaced much more easily.

In accordance with another aspect of the invention, at least the front portion of the tip is provided with side relief to reduce drag and wearing, require less power to drive the rolls, and lengthen the usable life of the tip. The side surfaces connecting the leading and trailing surfaces of at least the front portion of the tip are predominantly within the width of the leading surface. The provision of such side relief can reduce wear and drag irrespective of whether the tip is a two piece tip with a base and a wear cap, is a tip defined solely by a wear cap, or is a one piece tip with a working end and a mounting shaft. In one preferred construction, the front portion of the tip has a generally trapezoidal transverse configuration with the leading surface being wider then the trailing surface. Nevertheless, side relief could be provided with other constructions.

In another aspect of the invention, the front portion of the tip has side relief in its penetration profile for increased reduction in wear and drag. The penetration profile is the transverse configuration taken in the general direction of the material flow relative to the tip during operation of the machine.

It has been determined that the intensive wearing effects associated with the operation of a driven roll is experienced primarily on the front end of the tip and in the primary direction of the flow of the material relative to the movement of the tip. By providing side relief in this portion and in the direction of the primary flow of the material, hardfacing need only be provided on this front end without shortening the useable life of the tips. The use of less hardfacing reduces costs and eases manufacturing.

In another aspect of the invention, the tip has a leading surface inclined upward to the front surface to define a foremost impact corner for striking the rock and other earthen material. The intersection of the front and leading surfaces to define a corner as the foremost leading portion of the tip to strike the material provides a high strength construction that is not easily broken.

In another aspect of the invention, the front surface is inclined rearward from the leading surface in the primary direction of the flow of the material relative to the tip. Arranging the front surface at such an angle reduces the wear experienced by the tip and provides for even wearing of the tip.

In another aspect of the invention, the tip is attached to the holder to restrict rotation of the tip about its longitudinal axis. This arrangement simplifies the mounting assembly and enables the use of more varied mounting constructions.

In another aspect of the invention, the renewing of worn tips in an earth working machine having a driven roll can be accomplished easily and quickly. In a method in accordance with the present invention a retainer holding a wear cap of each worn tip that needs to be renewed is released. Each wear cap is removed from a seat that is secured to the roll. A new wear cap is installed onto each seat where a wear cap was removed. Each installed wear cap is then secured to the seat with a retainer.

DETAILED DESCRIPTION OF THE PREFERRED EMBODIMENTS

Figure 1:
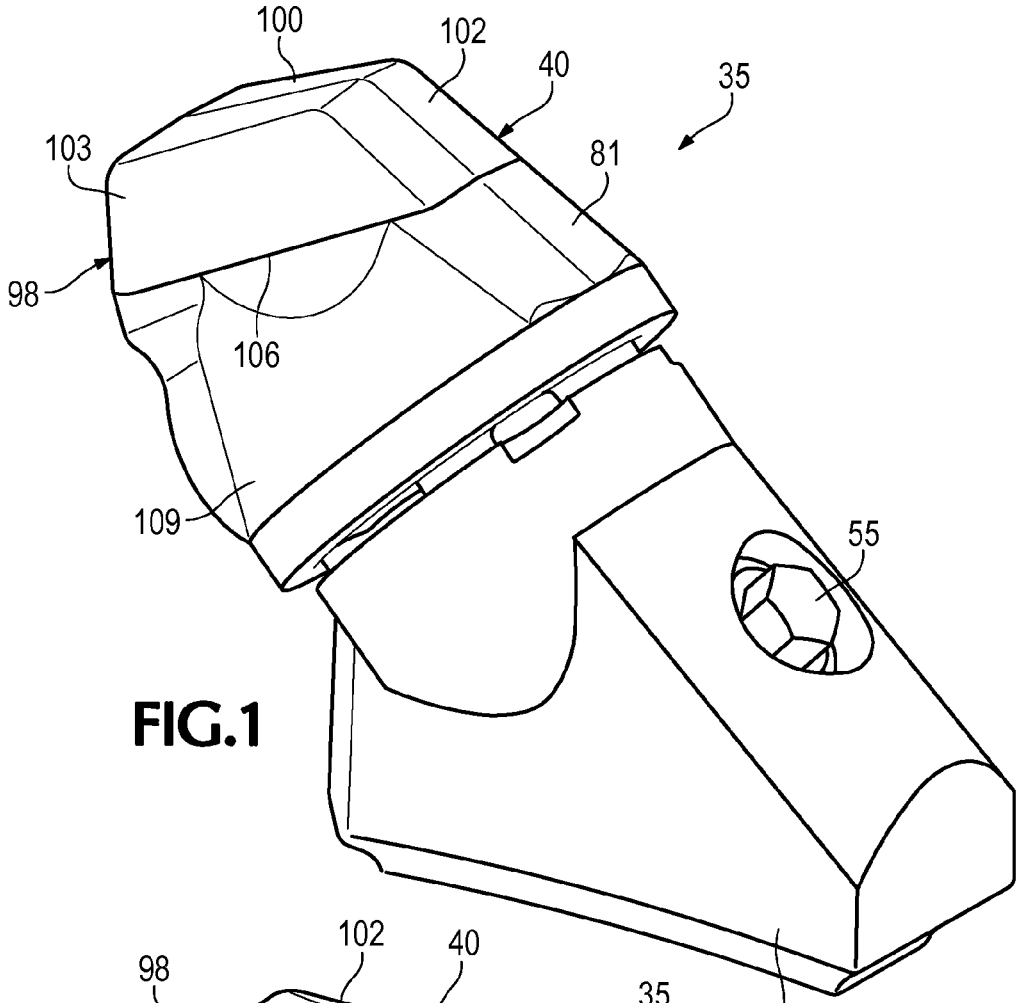
FIGS. 1 and 2 are each a perspective view of a tip in accordance with the present invention mounted in a holder.
Figure 2:
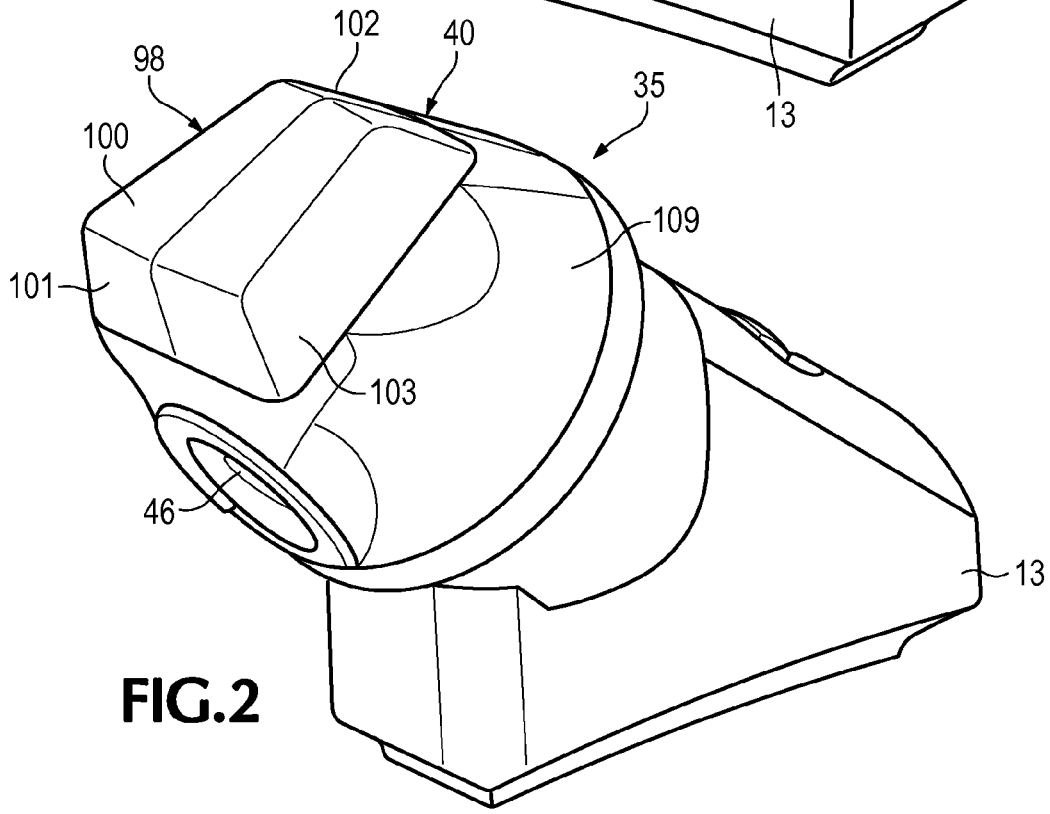

The present invention pertains to tips for an earth working roll or roller such as used in roll crushers, surface miners, milling machines and the like. The tips are at times described in this application in relative terms such as upper, lower, front, rear, vertical, horizontal and the like. These relative directional terms are not essential to the invention. The orientations of the tips on an earth working roll change considerably during operation. Accordingly, the use of these relative terms is not to be limiting of the invention, but rather to ease the description. Also, the tips in this application are described primarily in the context of a double roll crusher. Nevertheless, the invention is not limited to this operation. Tips in accordance with the invention are also suitable for use in conjunction with other earth working machines involving the use of driven rolls with tips such as single roll crushers, scroll crushers, surface miners, underground mining machines, milling machines and the like.

In one embodiment of the invention (FIGS. 1-38), tip 35 is a two piece tip including a base 37 and a wear cap 40. Base 37 includes a mounting shaft 42 and a seat 44 for wear cap 40. The wear cap sets over the seat to engage the material to be worked, e.g., the mined material 1 fed into a double roll crusher 7. Wear cap 40 is a wear part that is releasably secured to base 37 by a retainer 46.

Figure 3:
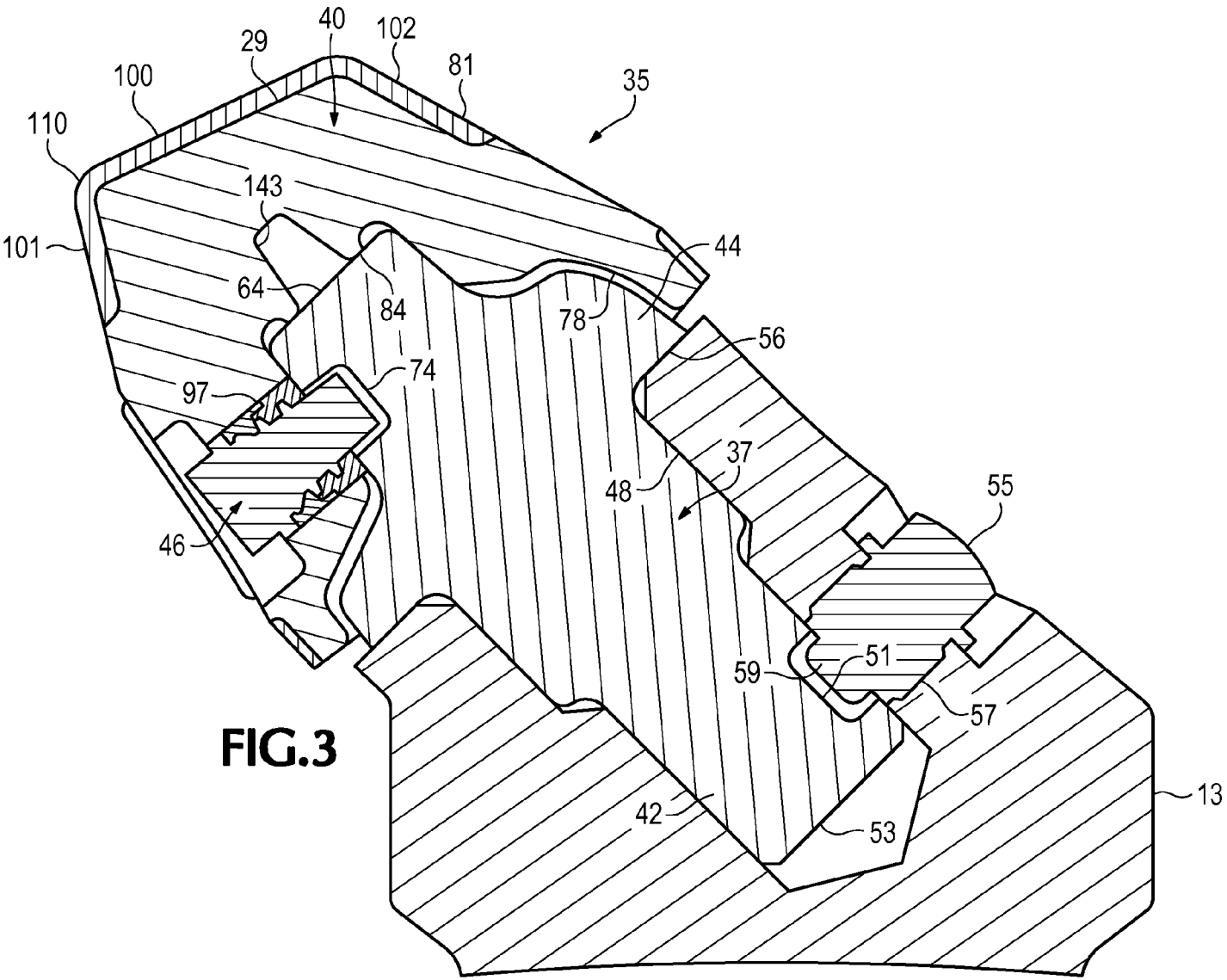
FIG. 3 is a sectional view of the tip mounted in a holder.
Figure 4:
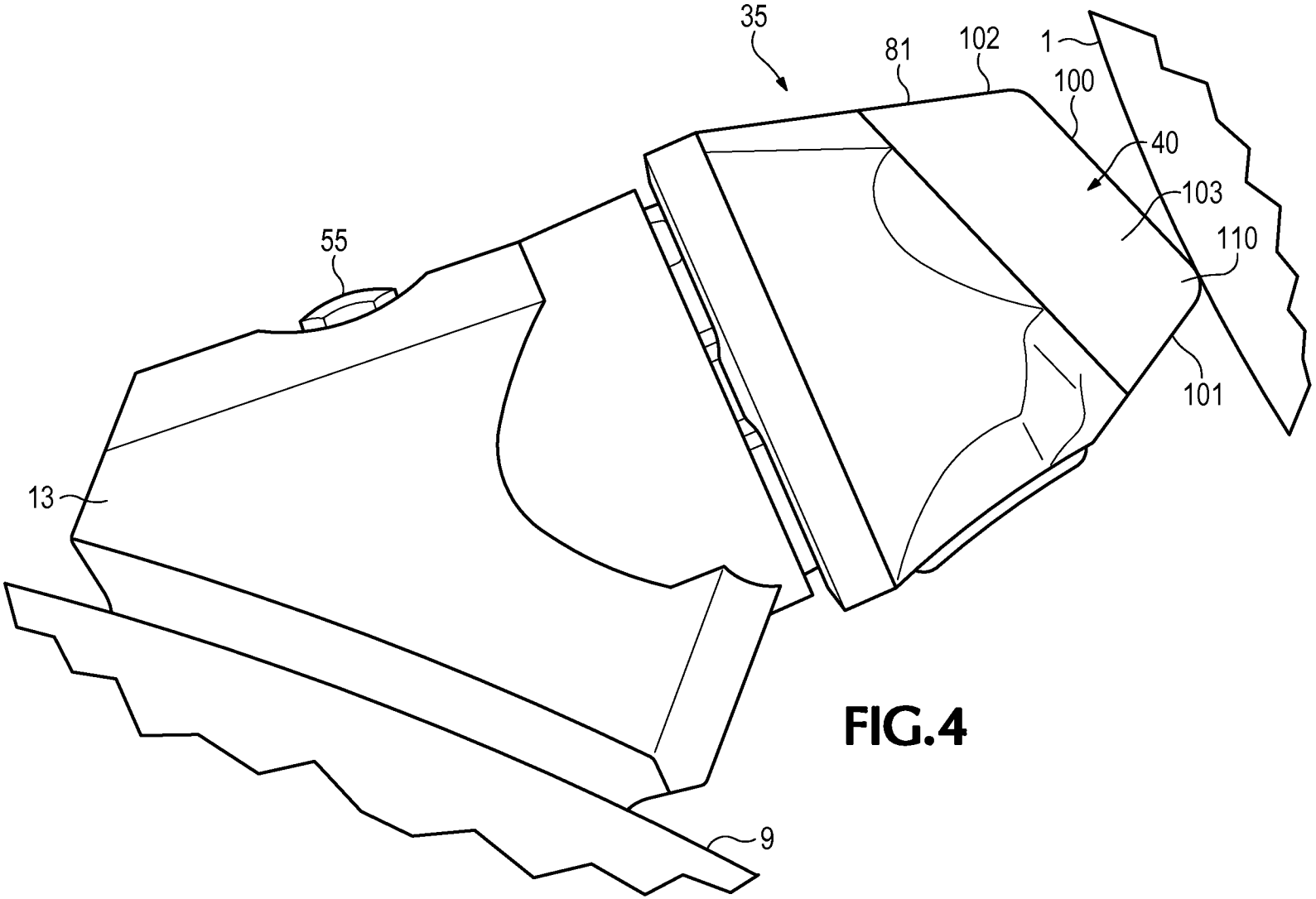
FIG. 4 is a side view of the tip mounted in a holder in operation in a double roll crusher.

The shaft 42 of base 37 is shaped for mating receipt within a hole 48 in holder 13 (FIG. 3). In this example, shaft 42 generally has a stepped, cylindrical configuration with a hole or depression 51 near its rear end 53 (FIGS. 11-20); though other configurations could be used. The hole 51 could extend entirely through shaft 42 but preferably only extends partially through the shaft. A mounting screw 55 is threaded through a bore 57 in holder 13 so that its free end 59 is receivable into depression 51 to contact the shaft 42 and retain the tip in the holder (FIG. 3). Since depression 51 is closed on its longitudinal sides 58 (i.e., sides extending generally in a longitudinal direction), the receipt of screw into it prevents rotation of tip 35 about its longitudinal axis 60 during use. Other means could be used to secure tip 35 to holder 13 and other kinds of holders could be used. For example, a mounting screw placed at a different location or orientation could be used. A non-threaded retainer such as a block or pin with a retaining latch, a pin with other retaining means, keyed element, etc. could also be used. Also, the hole could have a different shape than shown. It is simply necessary to securely hold the tip to the roll with sufficient support to withstand the expected loads. In embodiments including side relief, rotation of the tip is prohibited. In other embodiments, rotation of the tip could be permitted if desired.

Seat 44 of base 37 sets atop the holder to receive and mount a wear cap 40 (FIGS. 11-22). Seat 44 preferably has a generally rounded exterior surface 62 that tapers toward front face 64, and a rear surface 65 adapted to bear against holder 13. Front face 64 is preferably flat and generally perpendicular to axis 60, but could have other shapes or orientations. Grooves 66 are preferably provided on opposite sides to receive rails 68 of wear cap 40 to prevent rotation of the wear cap about axis 60. Grooves 66 preferably extend entirely through seat 44 to maximize the retention force, but could have only a partial extension if desired. The marginal edges 69 of each groove 66 are oriented transverse to longitudinal axis 60, and are preferably inclined outward for easier manufacture and receipt of rails 68. Nevertheless, marginal edges 69 could also be horizontal. The grooves could be placed in different locations, though on opposite sides is preferred to provide maximum resistance to loads applied perpendicular to the longitudinal axis, i.e., in the direction of the movement of the tip when the roll is driven. The grooves could be curved or have other shapes. There could also be only one groove or more than two grooves. Finally, other structural arrangements could be used to prevent rotation of the wear cap and/or provide resistance to transverse loading of the tip.

Seat 44 also preferably includes stabilizing surfaces 70 to provide stable support for wear cap 40. Stabilizing surfaces 70 are vertically aligned (i.e., aligned generally in the direction the tip is moved as the roll rotates) and extending rearward from front face 64. Stabilizing surfaces 70 are substantially parallel to axis 60. The term "substantially parallel" includes surfaces that are parallel to axis 60 as well as those that are at a small angle $\alpha$ to axis 60, e.g., of about 1-7 degrees. The stabilizing surface preferably diverges rearward at a small angle to axis 60 for ease of manufacturing. Stabilizing surfaces 70 are preferably each at an angle to axis 60 of less than 5 degrees, and most preferably 2-3 degrees. The stabilizing surface 70 provides enhanced support for the wear cap 40 against impact and other applied forces during use. Struts 72 preferably extend to front face 64 between stabilizing surface 70 and grooves 66 for additional strength. A hole 74 is preferably formed in the lower stabilizing surface 70 for receipt of retainer 46, but other arrangements and other positions could be provided to cooperate with retainer 46.

Wear cap 40 includes a cavity 78 that opens or faces rearward to receive seat 44, and a wear surface 81 that faces generally forward for engaging material 1 (FIGS. 1-14 and 23-31). Cavity 78 corresponds to the configuration of seat 44. In the illustrated embodiment, cavity 78 is generally closed around its perimeter, but in other embodiments, the cavity may be open along one or more of its sides. The seat and cavity could have a wide variety of constructions so long as they provide sufficient support for the wear cap. The entire seat is preferably received into wear cap 40 to protect it from the earthen material and premature wear. Alternatively, the base could define the cavity and the wear cap the protruding seat.

In this embodiment, cavity 78 has a generally rounded configuration, particularly in the rear portion, to matingly receive the rounded exterior surface 62 of seat 44, and a front surface 84 that bears against front face 64. A pair of inwardly projecting rails 68 extends axially along opposite sides of cavity 78 for receipt within grooves 66. The sidewalls 87 of each rail 68 are shaped to match the shape of marginal edges 69. The receipt of rails 68 in grooves 66 resists rotation of wear cap 40 about axis 60 during use. Rails 68 also provide vertical support against loads applied to the wear cap (i.e., loads applied in the general direction the tip moves or in the opposite direction). Alternatively, rails could be provided on the seat and grooves on the cavity in the wear cap. Other arrangements for preventing rotation of the wear cap could also be used in lieu of or in addition to the rails and grooves.

Cavity 78 further includes upper and lower supports 89 with stabilizing surfaces 95 that fit within recesses 96 of seat 44 so that stabilizing surfaces 95 contact and bear against the complementary stabilizing surfaces 70. Stabilizing surfaces 95, like stabilizing surfaces 70, are substantially parallel to the longitudinal axis 60. While stabilizing surfaces 70, 95 are preferably flat, they could be curved or have other configurations. Moreover, as an alternative, stabilizing surfaces 70, 95 could have a greater inclination to axis 60 and not be substantially parallel to axis 60 for certain applications, for example, those in lighter duty applications. Also, in certain applications, the wear cap and seat could each include only one stabilizing surface in engagement with each other to resist loading in one primary direction. Further, arrangements other than such stabilizing surfaces could be used to support the mounting of the wear cap on the base. An opening 97 is provided through the lower support 89 to align with hole 74 in base 37 when the wear cap is mounted on the base for receipt of retainer 46.

Wear surface 81 has a front portion 98 that makes initial and primary contact with material 1 and, in a roll crusher 7, is primarily responsible for breaking up the material. The front portion 98 includes a front surface 100 facing generally forward or outward from the holder, a leading surface 101 facing generally in the direction the tip moves with the roll, a trailing surface 102 opposite the leading surface, and side surfaces 103 extending between the leading and trailing surfaces 101, 102. The front portion 98 is preferably formed with side relief to reduce wear and drag on the tip so that the usable life of the tip is lengthened and less power is needed to drive the roll. Side relief is provided by forming the side surfaces 103 to be predominantly within the width or lateral sides 105 of the leading surface 101.

In this embodiment, side surfaces 103 are generally planar and inclined inward from the leading surface 101, i.e., the side surfaces 103 generally converge toward each other as they extend to trailing surface 102. This arrangement provides a front portion 98 for wear cap 40 that has a generally trapezoidal transverse configuration. In this embodiment, portions of the leading surface 101 are wider than the opposite, corresponding portions of the trailing surface 102; the corresponding portions of the two surfaces 101, 102 being those that are opposite each other in a direction perpendicular to the longitudinal axis 60. This inward inclination enables side surfaces 103 to be protected by leading surface 101 and experience reduced pressure from and contact with the earthen material 1; see the general flow F of material 1 relative to the front portion 98 in FIGS. 5, 7 and 15. Reduced pressure and contact translates into reduced wearing of the tips and lessened drag on the rolls being rotated. It has been determined that the primary contact with material 1 and wearing of the tips occurs along the front end of the tips. Side relief, then, is preferably provided only along front portion 98. In this way, rear portion 109 expands to accommodate an expanded rear portion of seat 44 for strength of the seat and a stable support against holder 13. Nevertheless side relief could extend through most or the entire wear cap. The front end of seat 44 also preferably has a generally trapezoidal shape to better accommodate the exterior side relief in wear cap 40.

Figure 5:
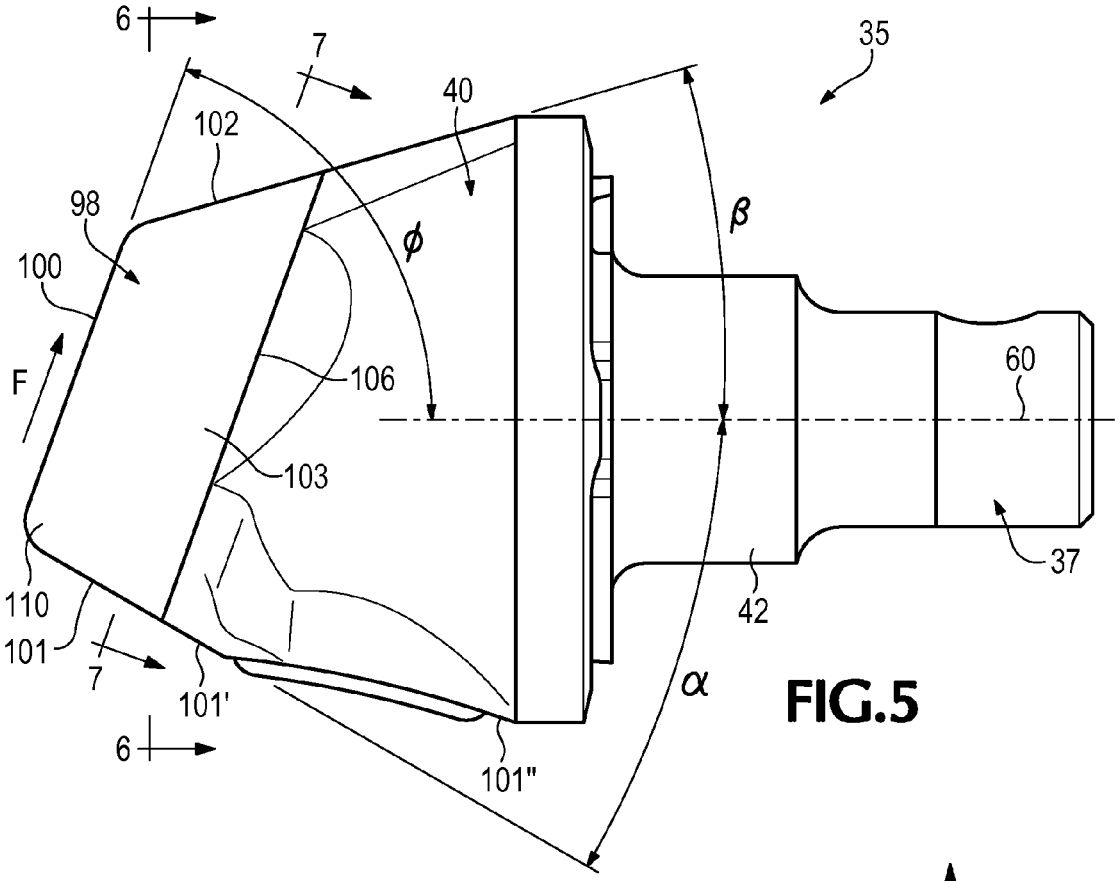
FIG. 5 is a side view the tip.
Figure 6:
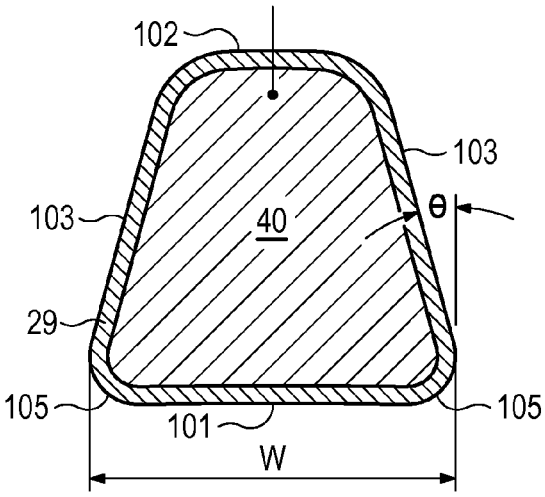
FIG. 6 is a cross sectional view taken along line 66 in FIG. 5.
Figure 7:
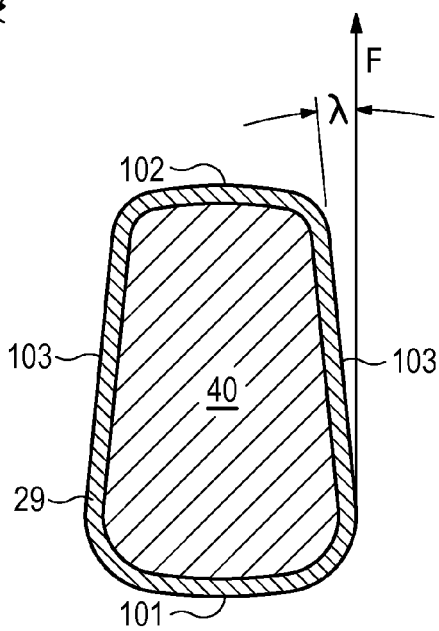
FIG. 7 is a cross sectional view taken along line 7-7 in FIG. 5.
Figure 8:
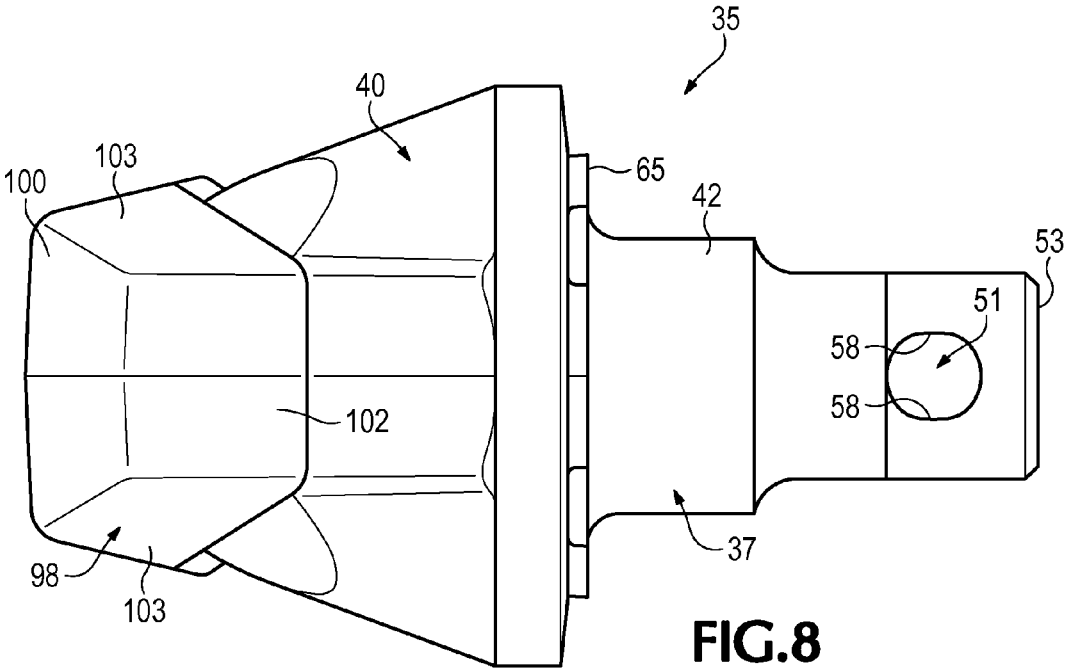
FIG. 8 is a top view of the tip.
Figure 9:
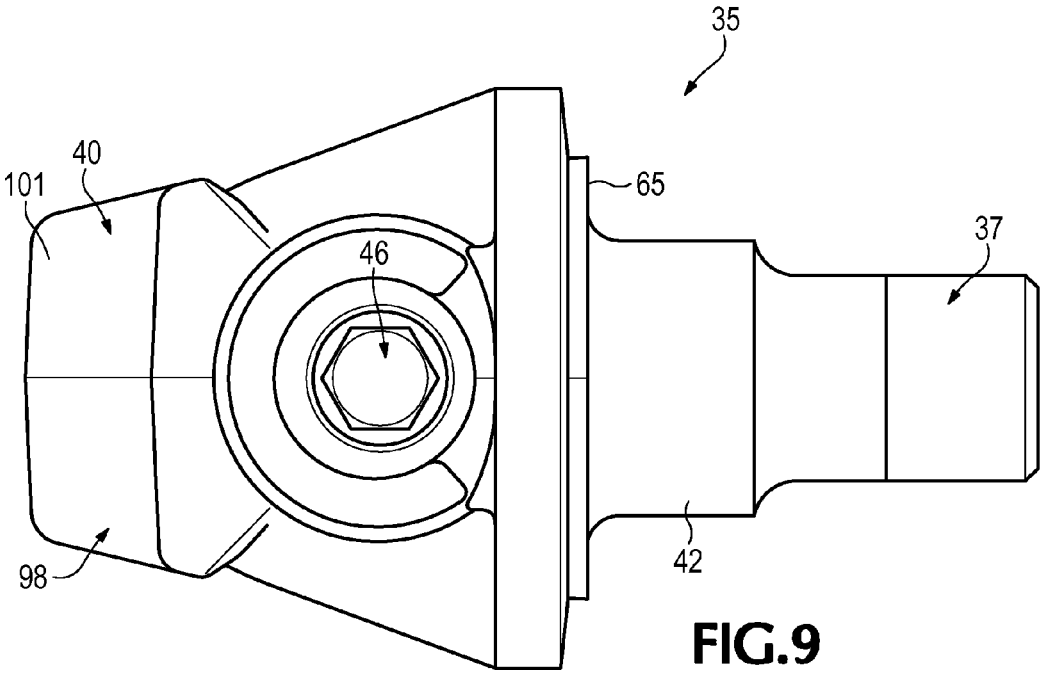
FIG. 9 is a bottom view of the tip.
Figure 10:
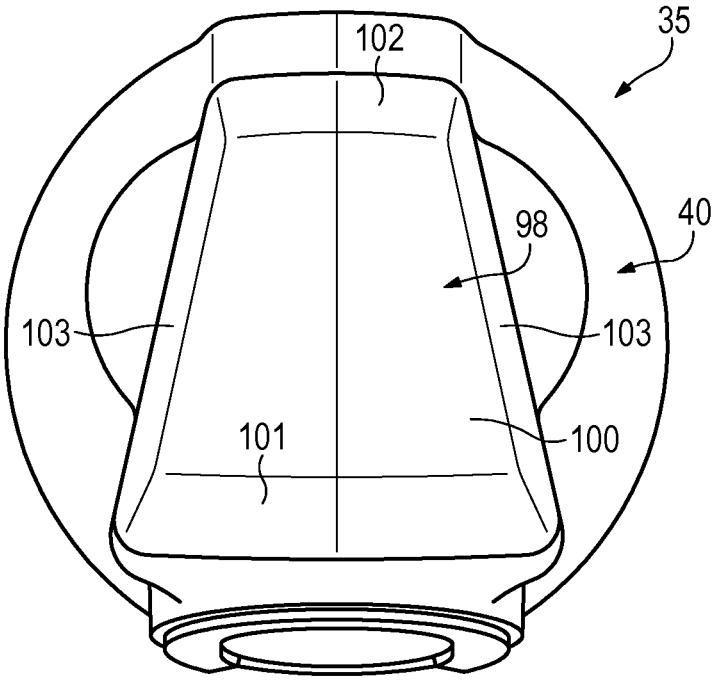
FIG. 10 is a front view of the tip.
Figure 11:
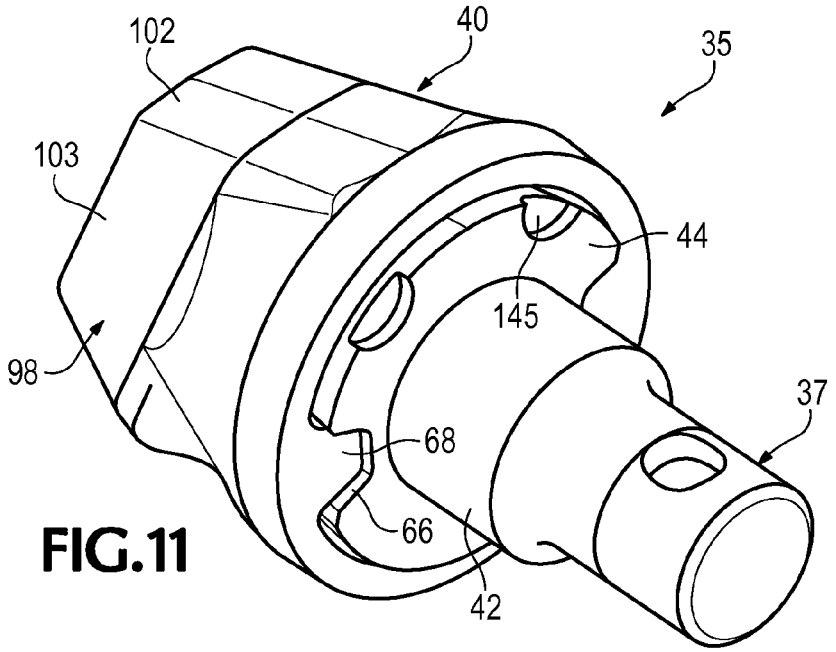
FIG. 11 is a perspective view of the tip.
Figure 12:
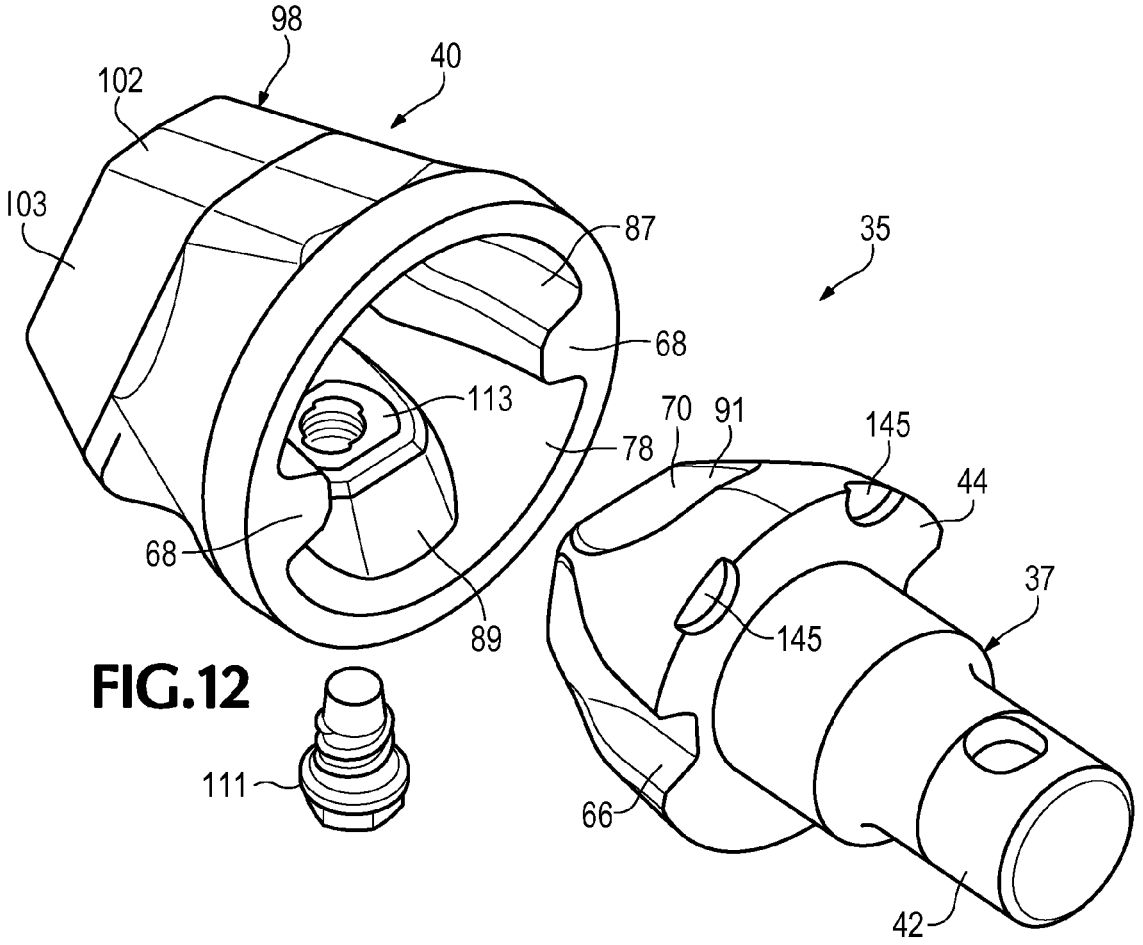
FIG. 12 is an exploded perspective view of the tip.
Figure 13:
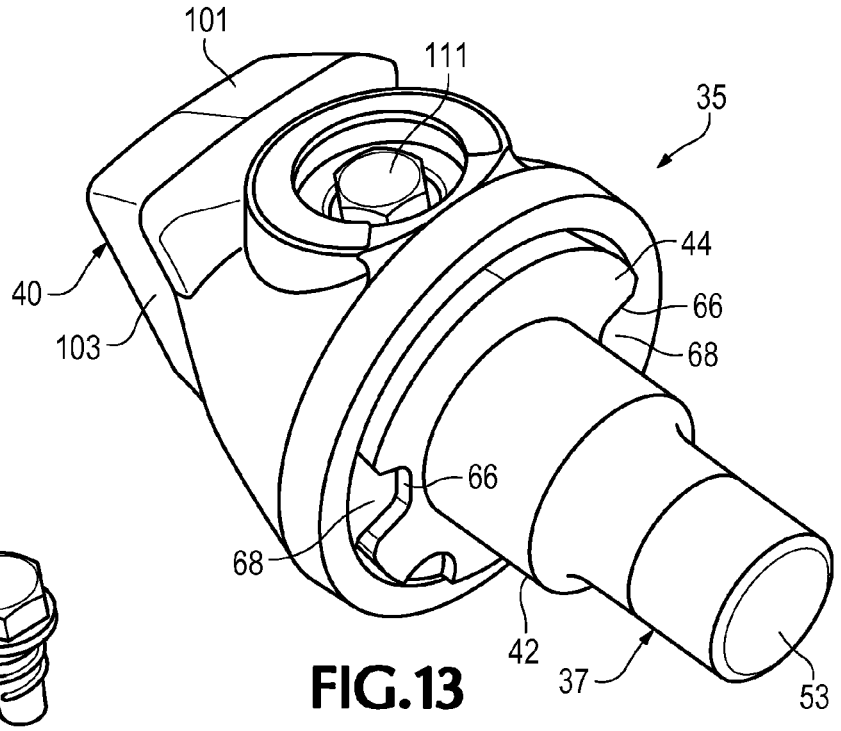
FIG. 13 is a perspective view of the tip in an inverted position.
Figure 14:
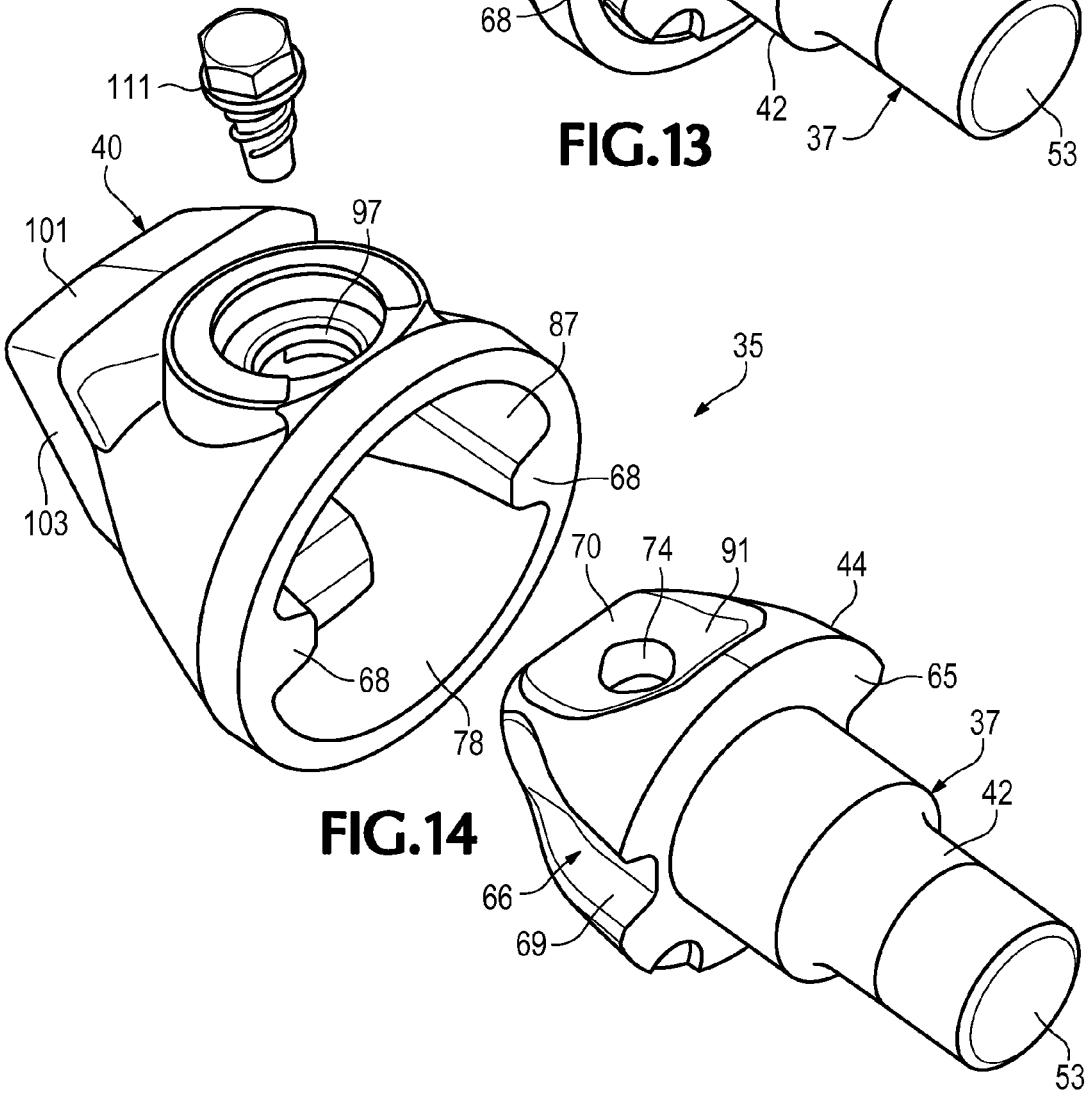
FIG. 14 is an exploded perspective view of the tip in an inverted position.
Figure 15:
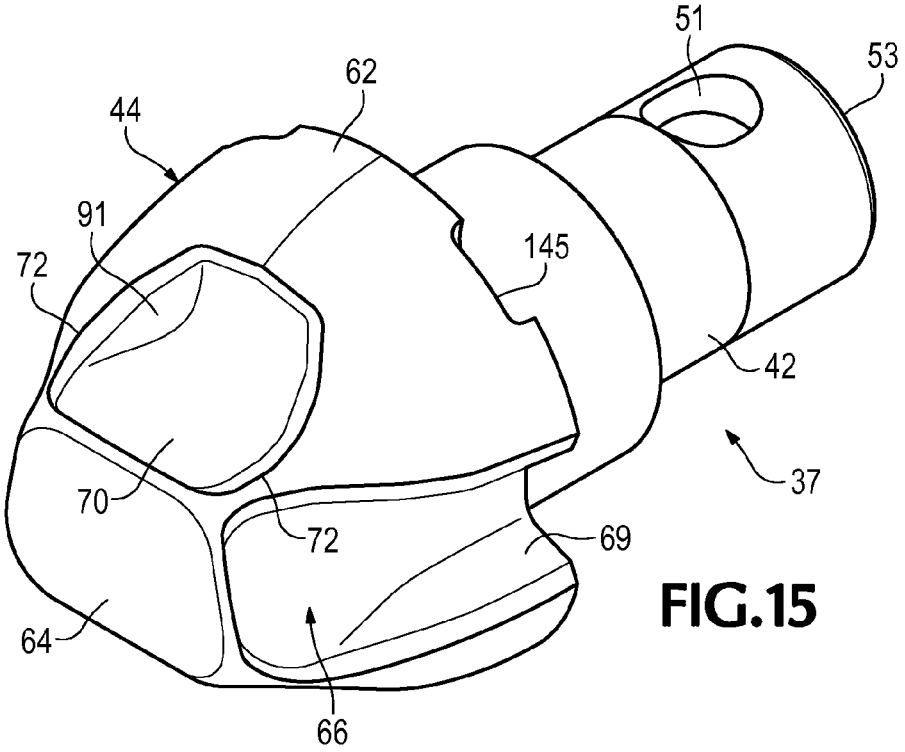
FIGS. 15 and 16 are each a perspective view of a base of the tip.
Figure 16:
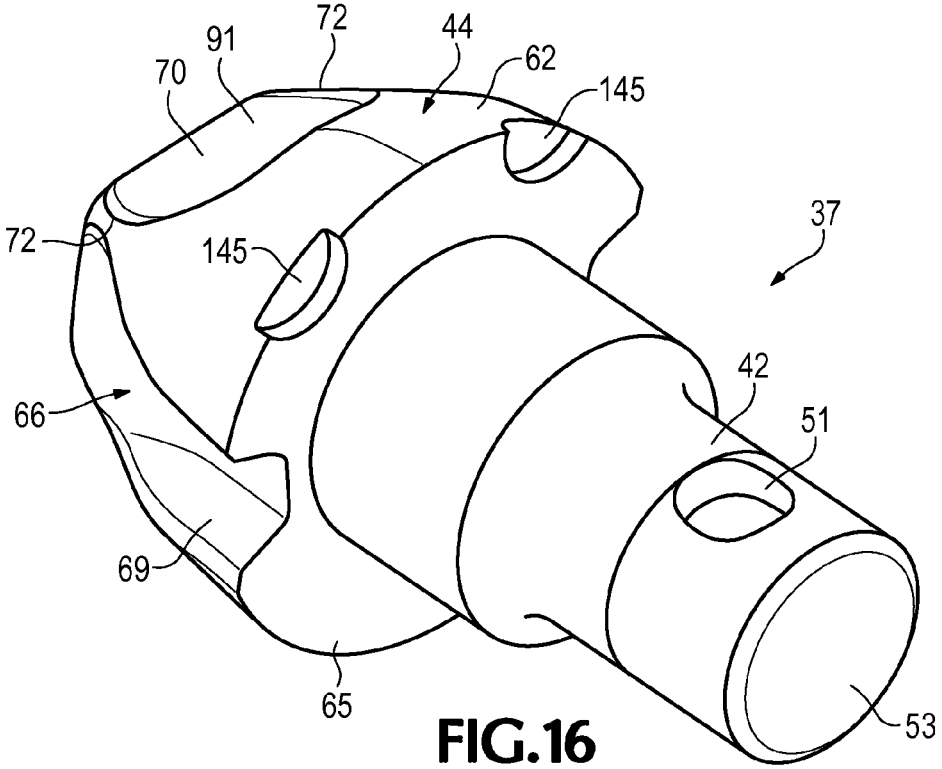
Figure 17:
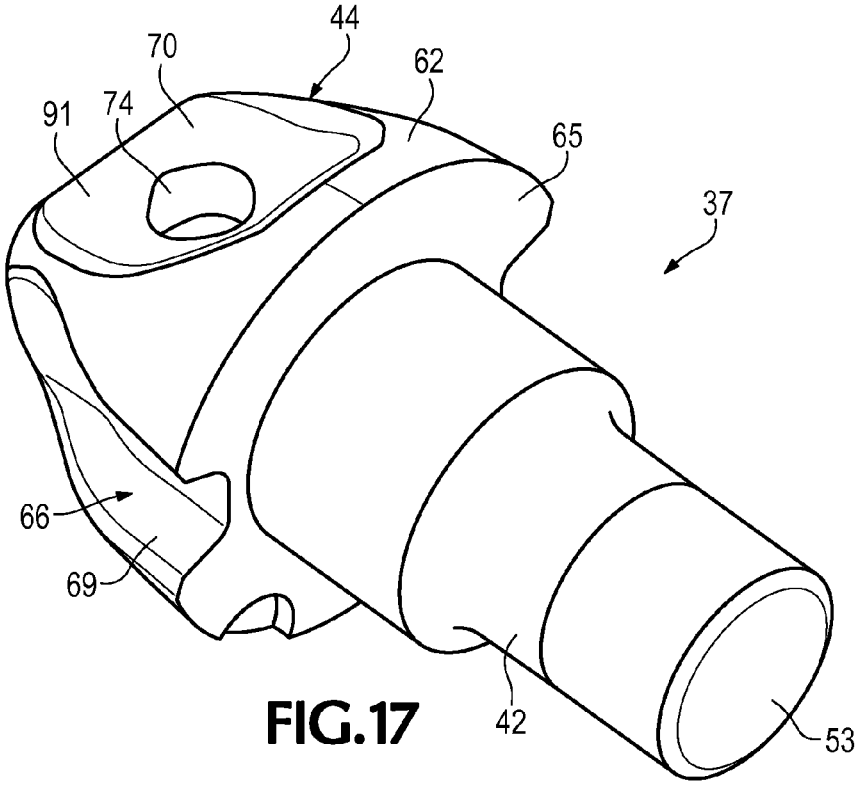
FIG. 17 is a perspective view of the base in an inverted position.
Figure 18:
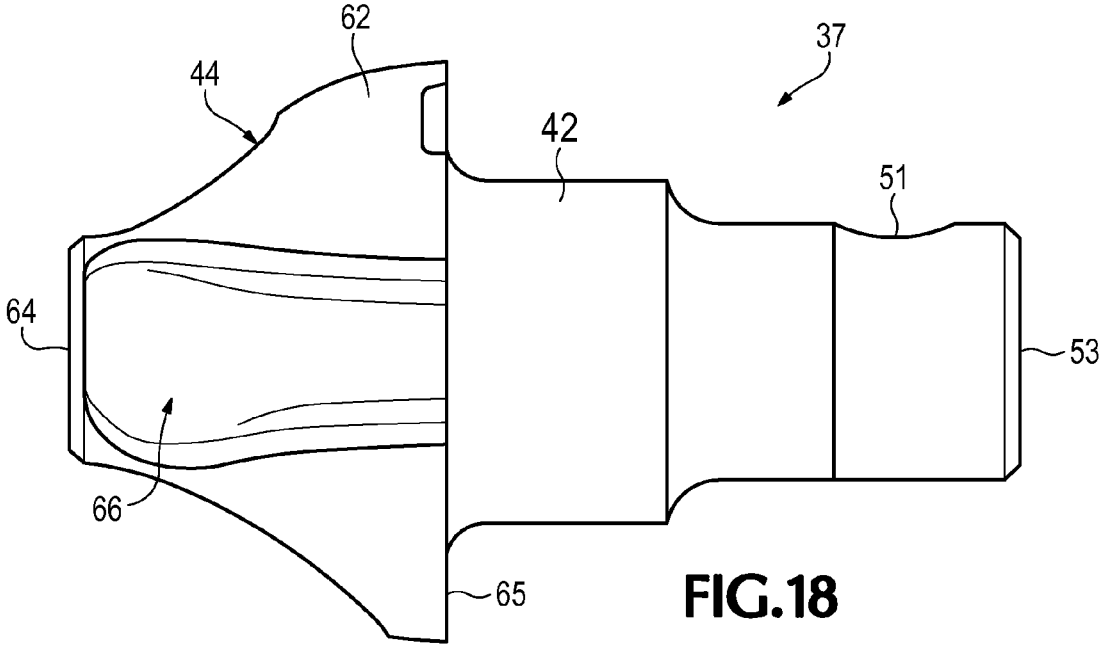
FIG. 18 is a side view of the base.
Figure 19:
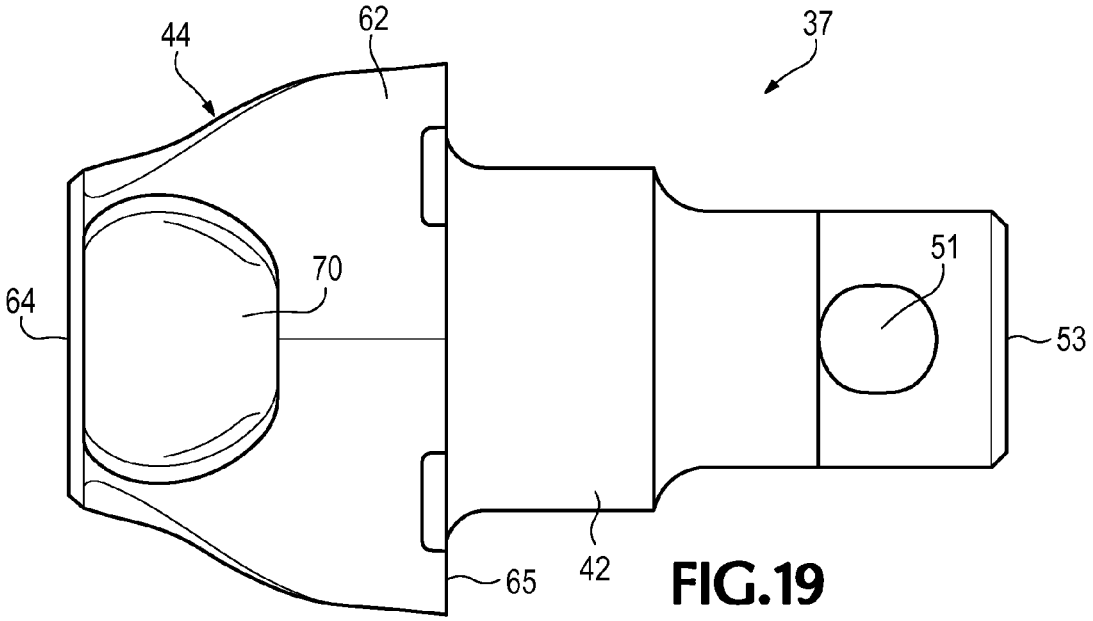
FIG. 19 is a top view of the base.
Figure 20:
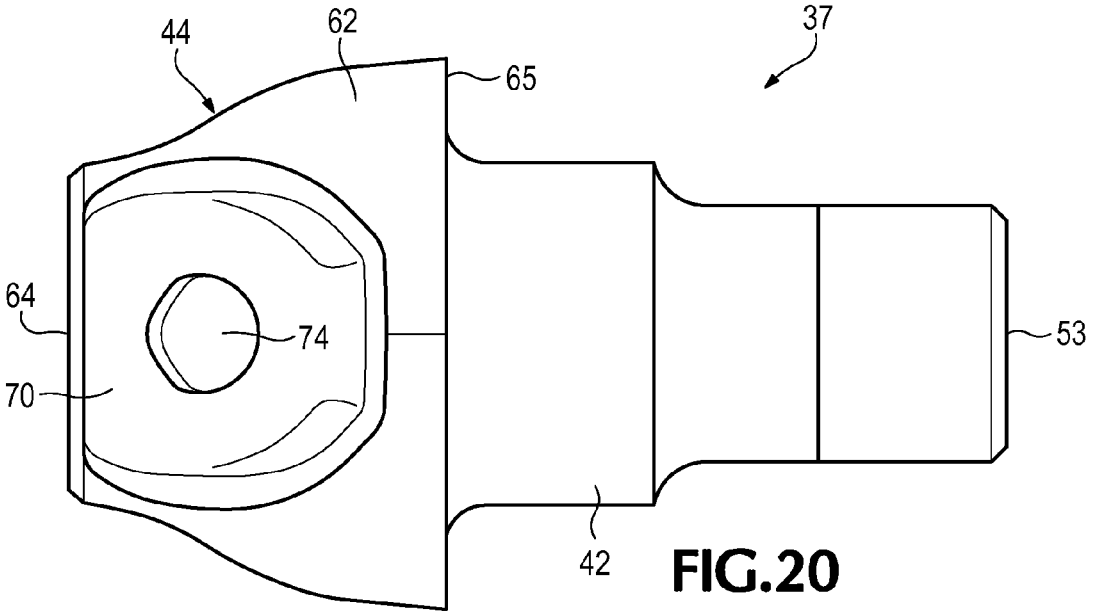
FIG. 20 is a bottom view of the base.
Figure 21:
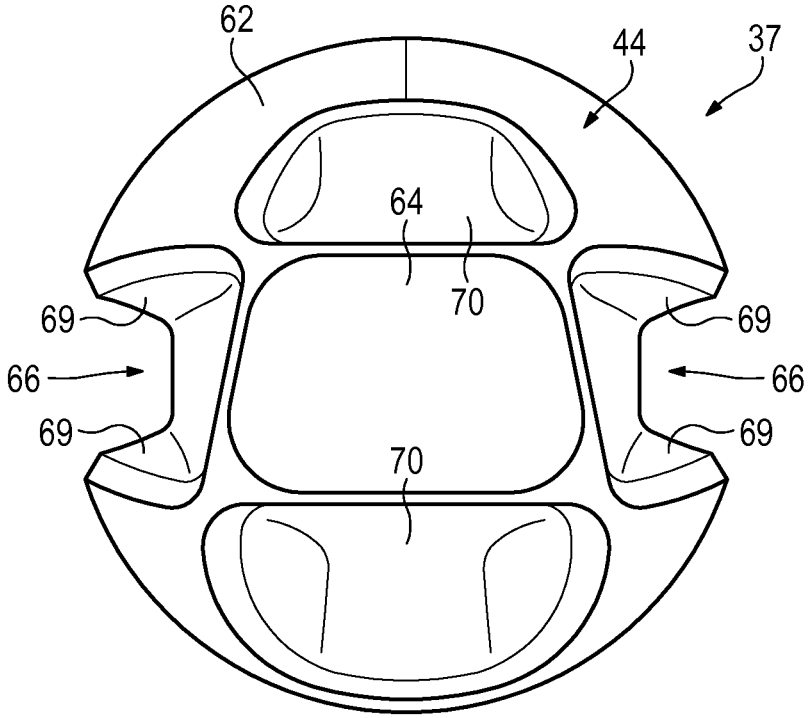
FIG. 21 is a front view of the base.
Figure 22:
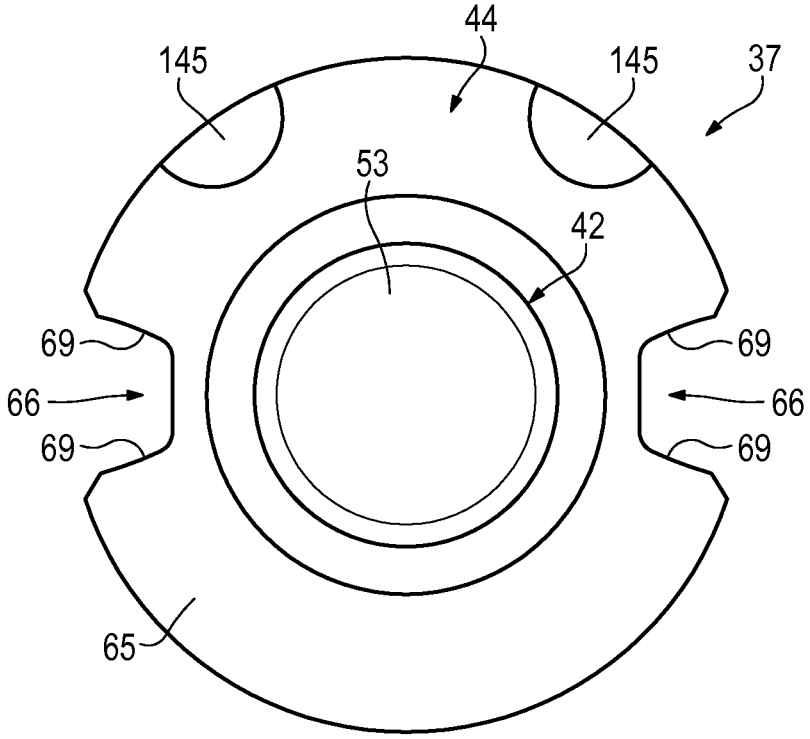
FIG. 22 is a rear view of the base.
Figure 23:
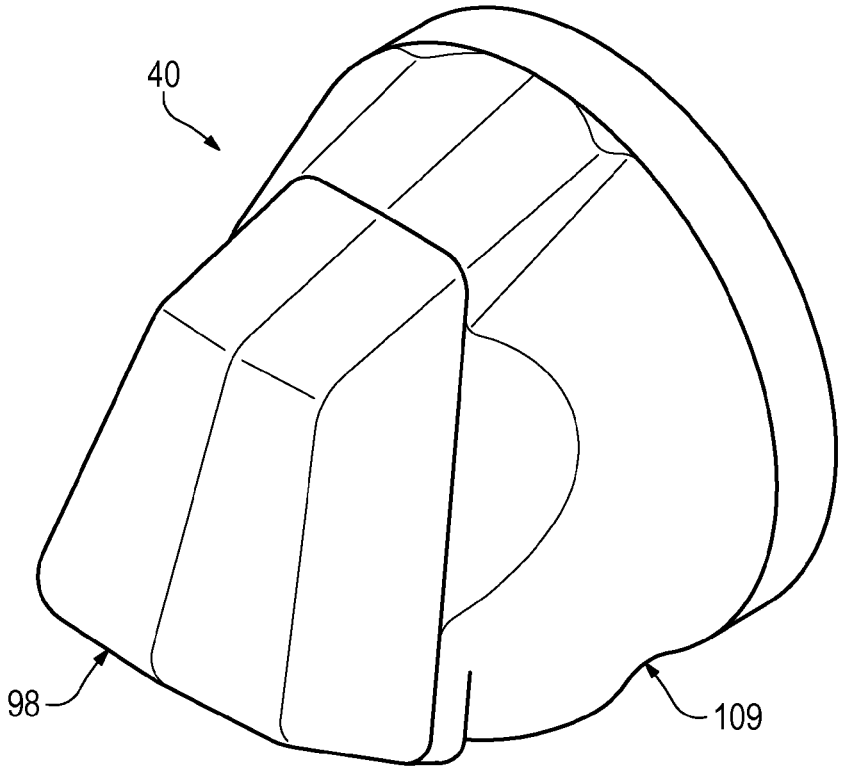
FIGS. 23 and 24 are each a perspective view of a wear cap of the tip.
Figure 24:
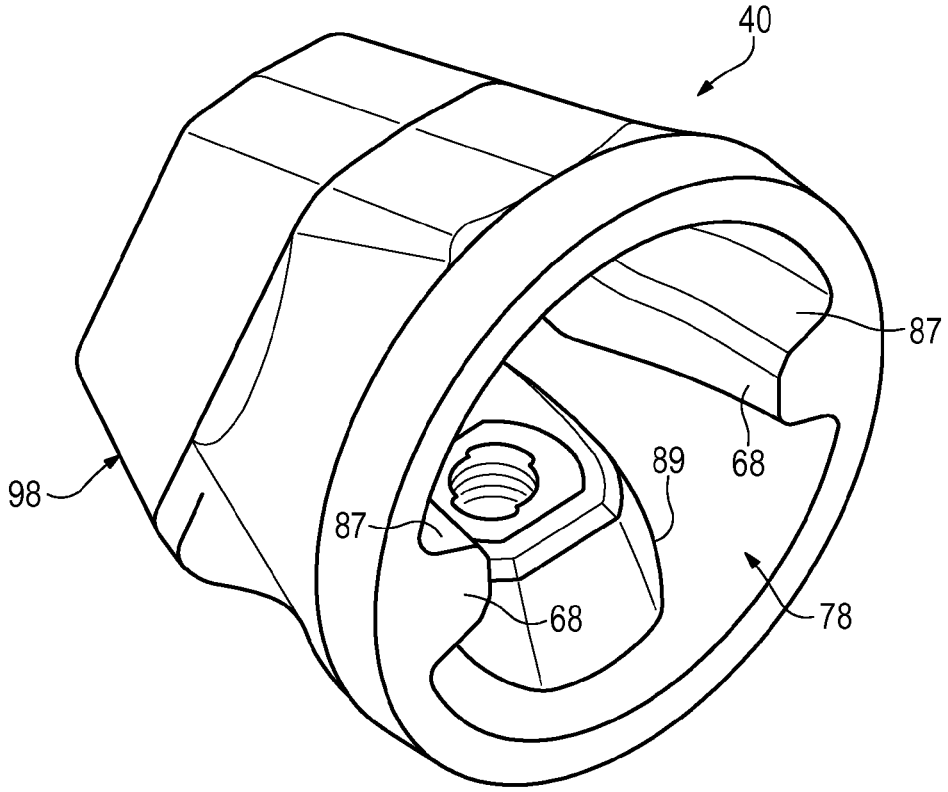
Figure 25:
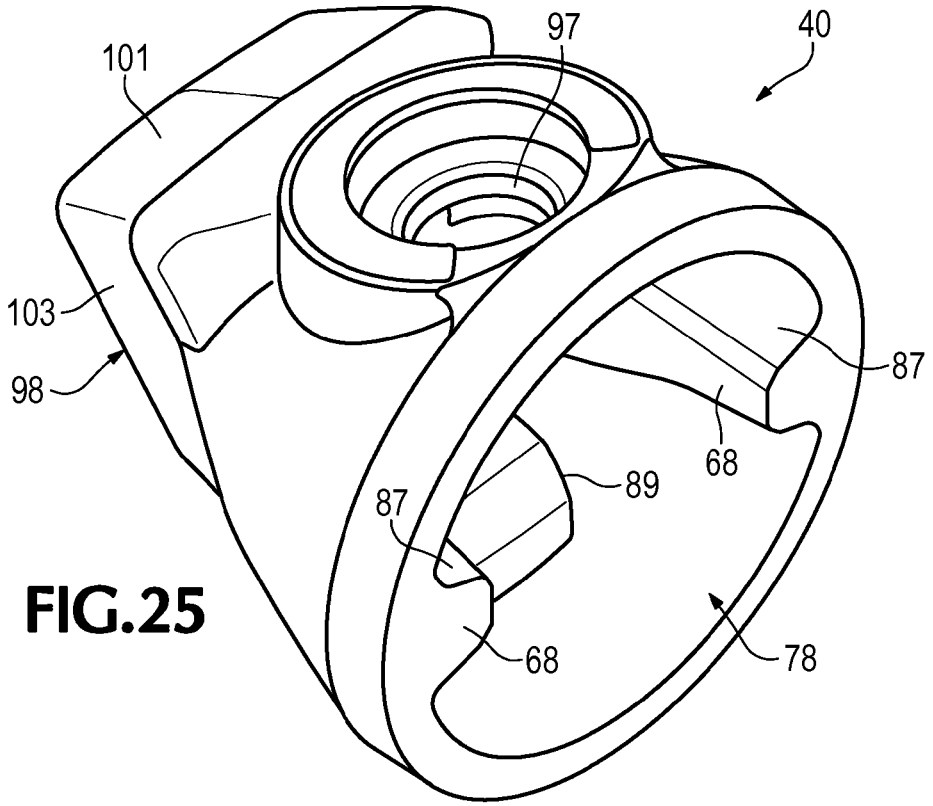
FIG. 25 is a perspective view of the wear cap in an inverted position.

The side surfaces 103 are each preferably inclined inward at a transverse angle $\theta$ so that they are within the width W of leading surface 101 (FIG. 6). In this way, side surfaces 103 travel in the shadow of leading surface 101 passing through material 1 so that they experience less wear and drag. In one preferred construction, the transverse angle θ is sufficiently great so that the side surfaces 103 of front portion 98 are inclined inward in the penetration profile for the wear cap 40 (FIG. 7). The penetration profile is the cross-sectional configuration of the tip taken in the primary direction of the flow of the earthen material 1 relative to the tip. For example, in a double roll crusher 7, the earthen material tends to flow relative to the tips at an inclination to the longitudinal axis 60 of the tips 35 (FIG. 5). In conventional tips, this relative movement causes wear to develop in cone 23 at this inclination to the longitudinal axis 60, particularly when fines prohibit rotation of the tip. In one exemplary double roll crusher 7, the flow of material 1 relative to the tip is at an angle of about 70 degrees to the longitudinal axis 60. The penetration profile for tips in this machine would then be along a transverse plane at an angle of about 70 degrees relative to axis 60. By providing side relief in the penetration profile, side surfaces 103 remain inward of the leading surface 101 with respect to the primary flow of the material relative to the tips. This arrangement provides enhanced protection for the tip and further reductions in the drag on the roll.

In one preferred example, side surfaces 103 are inclined to define a transverse angle θ of about 15 degrees (FIG. 6) so as to provide about a 5 degree angle λ in the penetration profile (FIG. 7). As can be appreciated, a 15 degree transverse angle θ results in the side surfaces converging toward each other with an included angle of about 30 degrees. Nevertheless, side surfaces 103 may be inclined at other transverse angles and still provide some benefits of side relief. While inclining each side surface 103 in the penetration profile at an angle λ of at least 5 degrees is preferred, smaller angles will still result in reduced wear and drag. Also, side surfaces 103 that are predominately within the width of the leading surface 101, but which are not inclined inward in the penetration profile will still provide reduced wear and drag as compared to tips with no side relief. Although side relief is preferably only provided in front portion 98, it could be extended into rear portion 109 as well.

Front surface 100 of wear cap 40 is preferably inclined to axis 60 at an angle that is generally parallel to the direction of the relative flow of material 1 to tip 35. Accordingly, front surface 100 is preferably inclined at an angle ϕ of about 70 degrees to longitudinal axis 60 for a double roll crusher. Nevertheless, other angular orientations could be used. Although a planar front surface 100 is preferred, the front surface could alternatively have a slight concave or convex curvature. Moreover, the front end could have other shapes including a blunt rounded front end, a sharp digging point, or other configurations. The front surface may optionally be formed of carbide or another hard material or have hard inserts of carbide, ceramic or other hard material.

Leading surface 101 is preferably inclined forwardly and upwardly relative to axis 60 so that the foremost portion of wear cap 40 is an impact corner 110 to strike rock and other earthen material needing to be broken up. The formation of a corner to primarily impact rock and the like is a strong construction that is not easily broken. Leading surface 101 preferably has a front segment 101' and rear segment 101", though it could have a uniform configuration rearward of front surface 100. In a preferred construction, front segment 101' extends rearwardly from front surface 100 at an angle α of about 30 degrees to axis 60 to form impact corner 110. Rear segment 101" is preferably inclined at a smaller angle relative to axis 60 to offer some shielding of retainer 46. Trailing surface 102 preferably extends rearward from front surface 100 at an angle β of about 15 degrees to axis 60. Nevertheless, other orientations are possible.

Wear caps in accordance with the invention can have shapes other than illustrated. The side surfaces can be placed at different angles to the leading surface. The side surfaces need not be planar and can be, e.g., curved, angular or irregular. Side relief benefits can still be obtained even if the side surfaces extend laterally beyond the width of the leading surface so long as the side surfaces are predominantly within the width of the leading surface; though confining the side surfaces entirely within the width of the leading surface is preferred. In addition, the leading, trailing and front surfaces can also be formed with non-planar shapes. In a front portion that is formed with curved surfaces, particularly a curved leading surface, there may be no clear delineation between the side surfaces and the leading surface. Side relief in accordance with the present invention could be provided in such instances if the side walls are positioned within the largest lateral width of the leading surface for more than half of the transverse distance between the foremost leading portion and the rearmost trailing portion of that portion of the tip provided with side relief (i.e., the distance between the leading and trailing surfaces and perpendicular to the longitudinal axis 60), and preferably more than about 75% of the distance.

Figure 26:
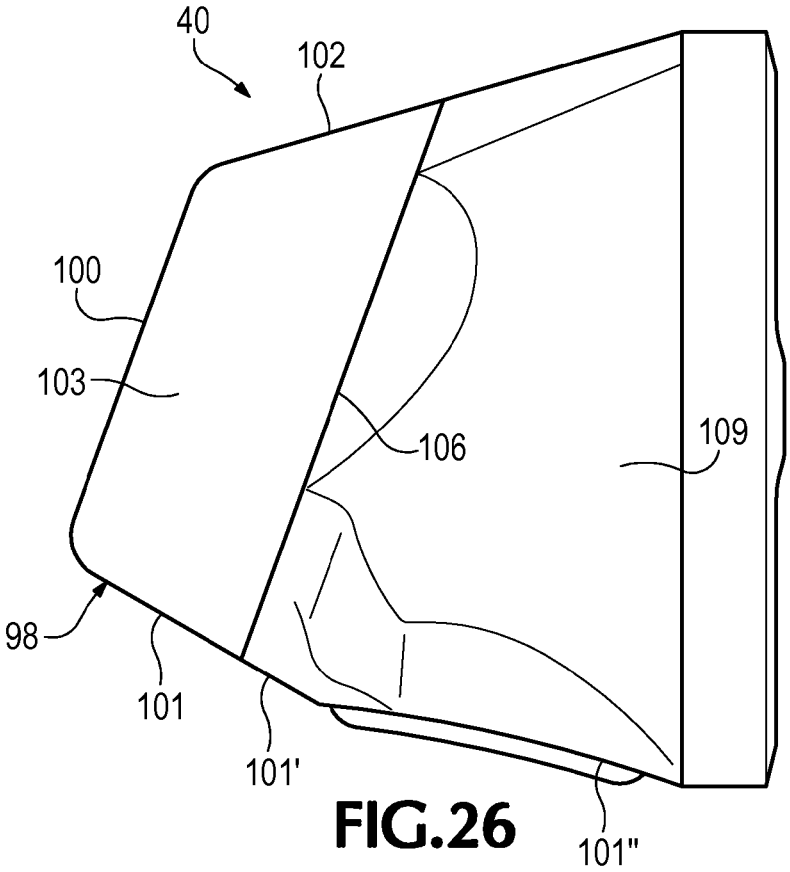
FIG. 26 is a side view of the wear cap.
Figure 27:
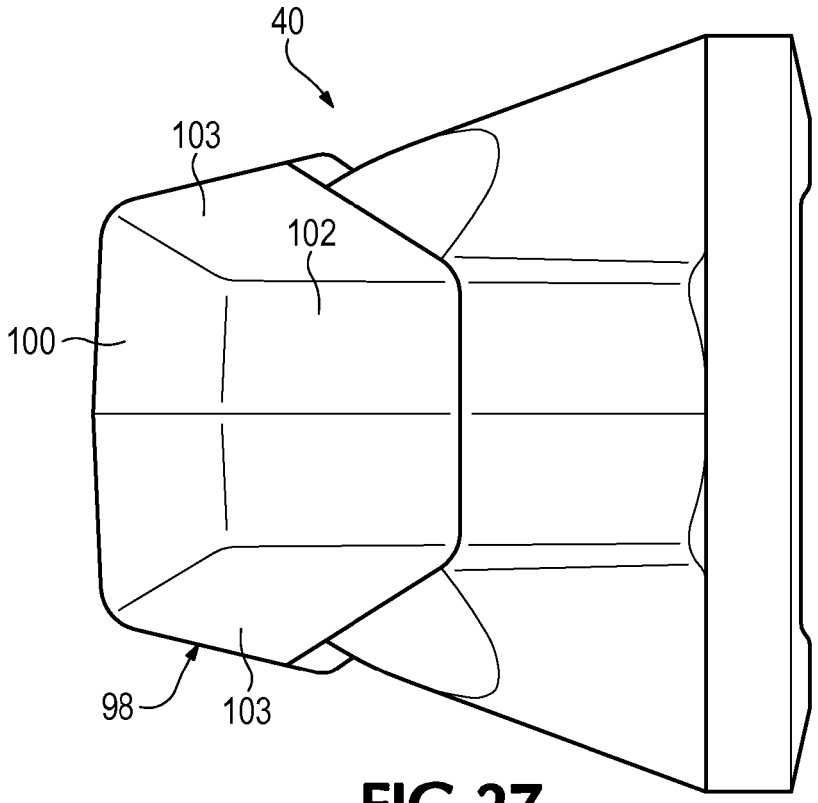
FIG. 27 is a top view of the wear cap.
Figure 28:
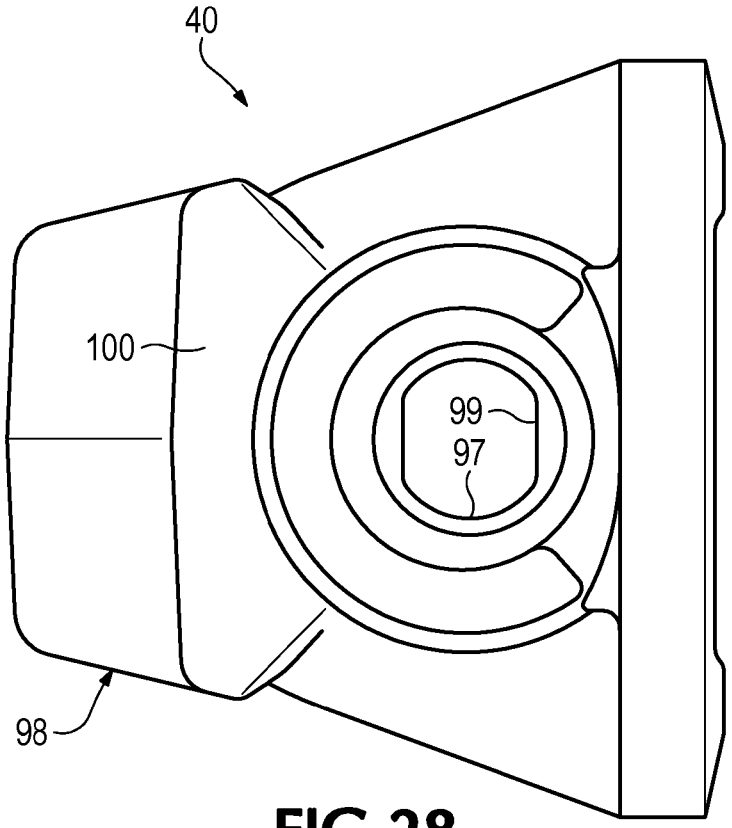
FIG. 28 is a bottom view of the wear cap.
Figure 29:
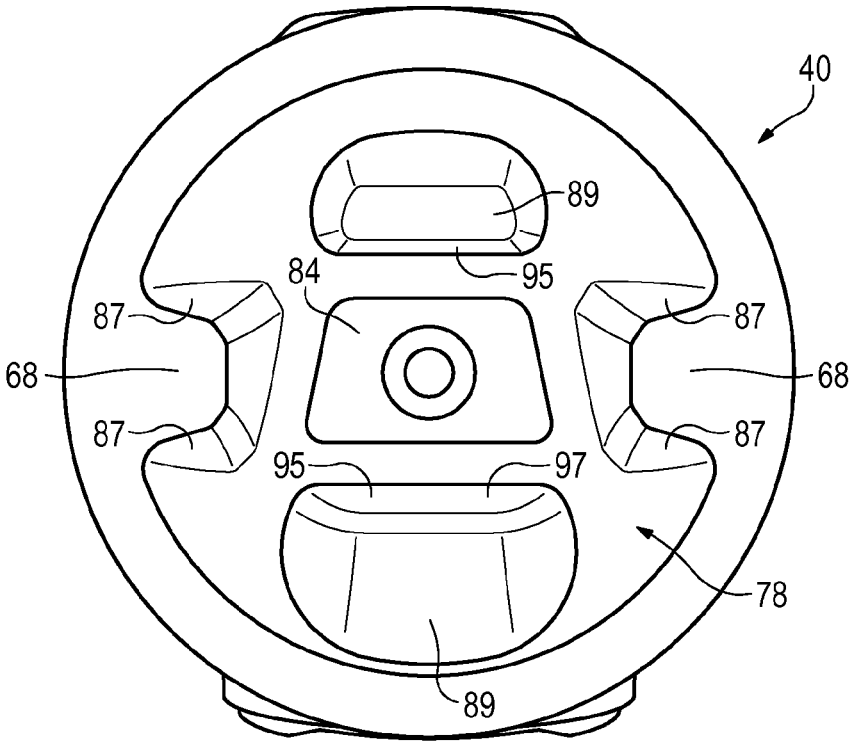
FIG. 29 is a rear view of the wear cap.
Figure 30:
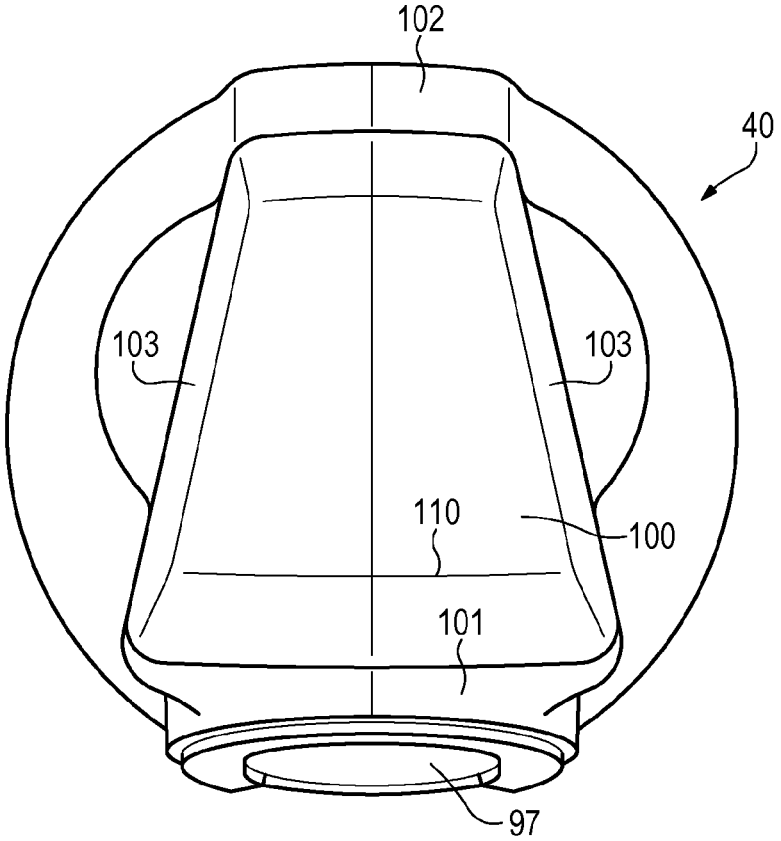
FIG. 30 is a front view of the wear cap.

Due the harsh environment during use, it is preferable to provide wear cap 40 with hardfacing. However, it has been determined that the most sever wearing occurs at the front of the tips and along a direction that is inclined to the longitudinal axis 60 of the tip. As a result, hardfacing need only be provided on the front portion 98 of wear cap 40 with its rear edge 106 along an inclination generally parallel to the primary direction of the flow of the material relative to the tip (FIGS. 1, 5 and 26). In one preferred construction, the hardfacing is applied in an even band at an angle of about 70 degrees to axis 60, which is preferably parallel to front surface 100. This limited use of hardfacing decreases the cost of the tip without any significant decrease in the useful life of the tip as compared to tips 11 with hardfacing over the entire cone 23.

Retainer 46 preferably includes a screw or male threaded member 111 and a nut or female threaded member 113 (FIGS. 3, 12, 14 and 31-38), though other kinds of retainers (with or without threads) could be used. Screw 111 has a threaded shaft 115 with a free end 117, and a head 119 with tool engaging means opposite free end 117. Nut 113 includes a threaded bore 121 and a pair of flat outer sides 123 to fit against flat sidewalls 99 in opening 97 to prevent rotation of the nut, though other non-circular shapes could be used. The nut is inserted into opening 97 from cavity 78. The nut can be retained in opening 97 by a flange on its inner end, by an interference fit with opening 97, by a corresponding narrowing of the nut and the opening, or other means. The use of such a nut enables opening 97 to be cast or otherwise formed without threads. Nonetheless, opening 97 could be formed with threads as an alternative. The threaded shaft 115 of screw 111 is threaded through bore 121 for receipt into hole 74 to hold wear cap 40 to seat 44.

In a preferred embodiment, nut 113 further includes a resilient member 133 to contact screw 111 and resist unwanted loosening during use. The resilient member is preferably a sleeve 133 that surrounds shaft 115. Sleeve 133 includes a flange 139 that fits around a reduced portion 141 of nut 113 to couple the sleeve 133 and nut together. Sleeve 133 could alternatively be initially secured to screw 111 by adhesive, molding or other means. In the illustrated example, sleeve 133 includes a rim 135 that snaps into a groove 137 adjacent head 119 as screw 111 is fed through bore 121, though other arrangements are possible. Sleeve 133 resists unwanted loosening of screw 111 during use, but permits retraction of screw 111 when turned with a tool such as a torque wrench. Other arrangements could be used to resist loosening such as lock nuts, etc. Sleeve 133 also works to seal opening 97 to lessen the embedding of fines among the threads of screw 111 and nut 113 and thereby ease the release of the lock. Sleeve 133 is preferably formed of a polymer such as urethane, but could have other compositions as well.

Nut 113 is preferably fitted in wear cap 40 during manufacture, but could be assembled by the operator. Likewise, screw 111 is also preferably attached to the wear cap (i.e., by threading into nut 113) so that the retainer 46 is integrally connected to the wear cap during manufacture as well. In this way, the proper fitting of nut 113 in opening 97 and sleeve 133 to screw 111 can be assured. Moreover, in this way, retainer 46 always remains a part of the wear cap 40 so that there is no need to store and keep track of a separate lock. The wear cap can be installed on the base with screw 111 in nut 113 provided free end 117 does not project into cavity 78, though screw 111 could be removed if desired. Once wear cap 40 is fully seated on seat 44, screw 111 is advanced so that free end 117 is received in hole 74 in base 37. Preferably, free end 117 does not press against the bottom surface 125 of hole 741 but it could be made to do so. Rather, head 119 preferably includes a peripheral flange 127 that is received into a counter bore 129 in opening 97 to stop advancement of screw 111 past this point. A larger counter bore 131 is also provided in wear cap 40 to permit a tool to engage head 119. Of course, other shapes and arrangements for nut 113, screw 111 and opening 97 could be used.

Figure 31:
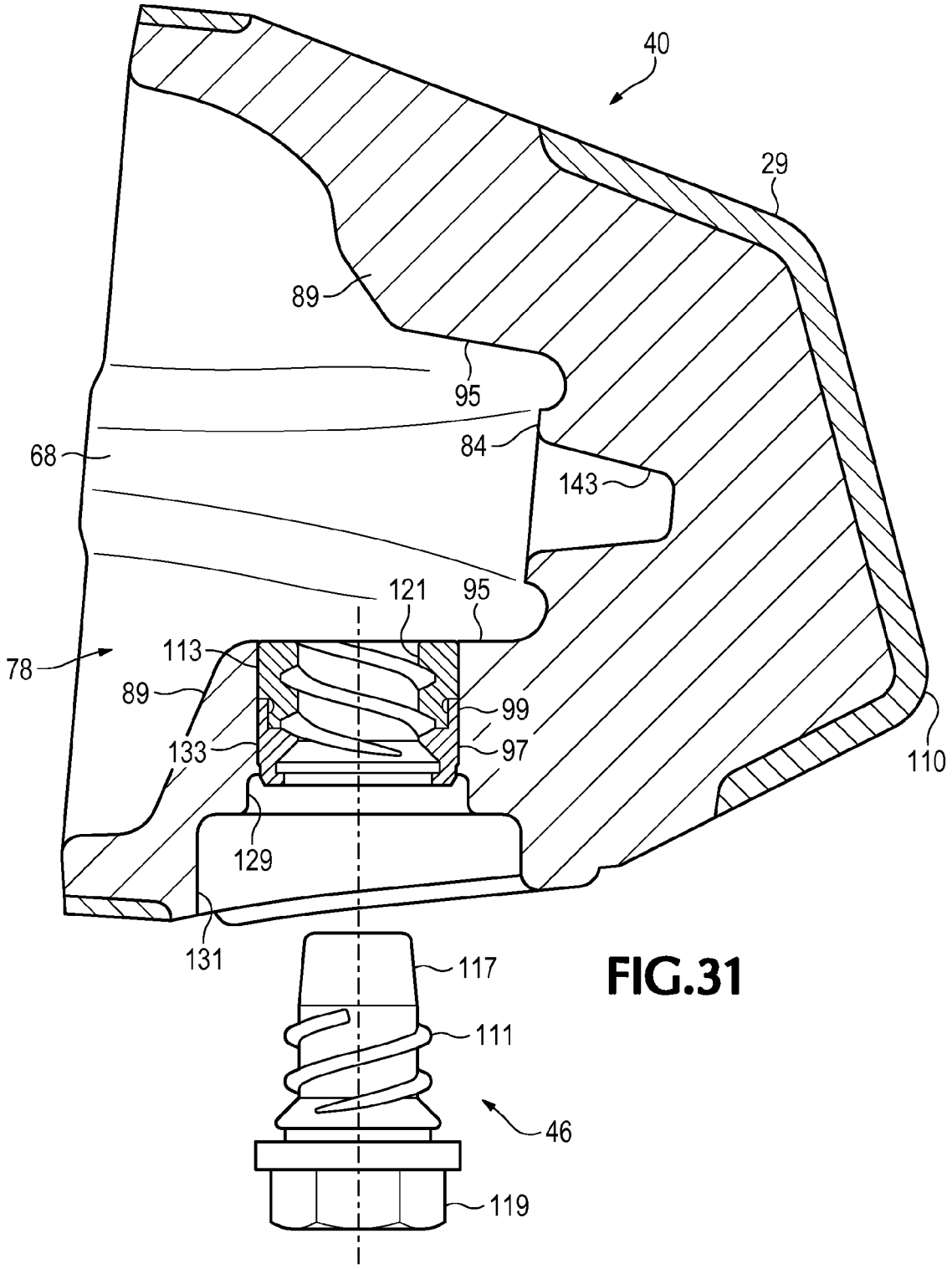
FIG. 31 is a cross sectional view taken along line 31-31 in FIG. 30 with a screw in exploded view.
Figure 32:
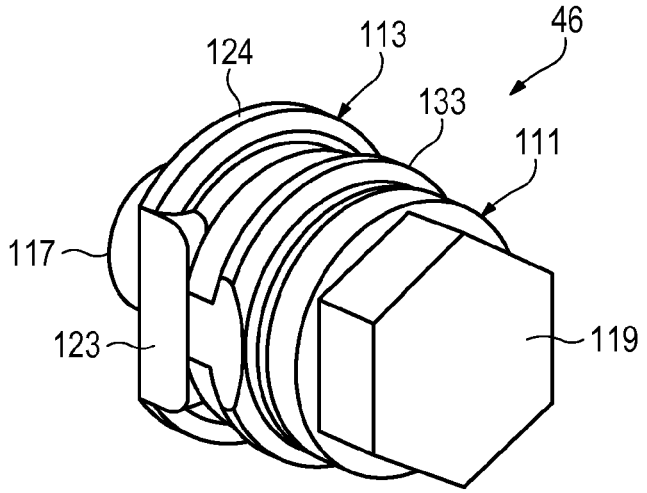
FIG. 32 is a perspective view of a retainer for the tip.
Figure 33:
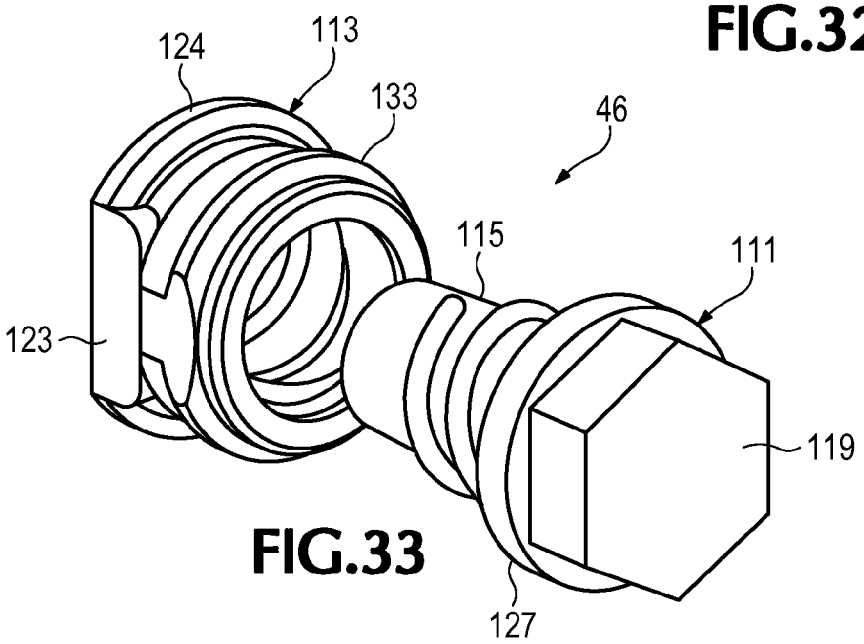
FIG. 33 is an exploded perspective view of the retainer.
Figure 34:
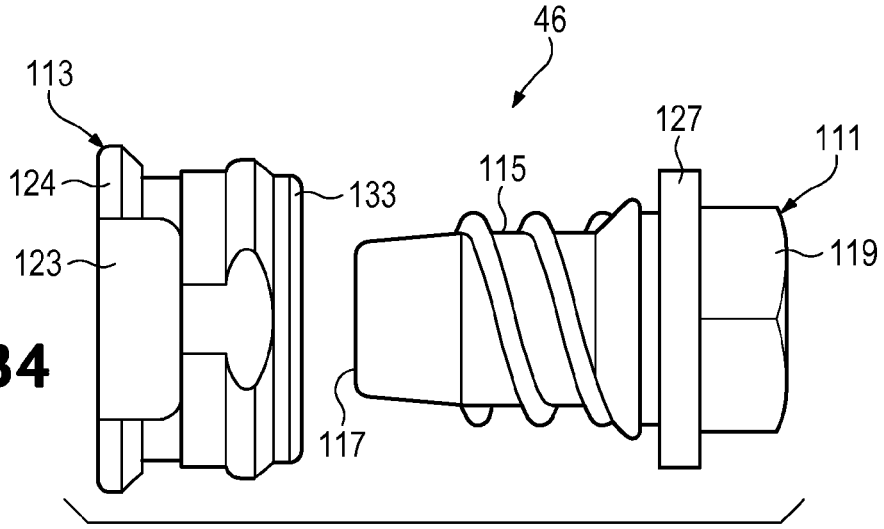
FIG. 34 is an exploded side view of the retainer.
Figure 35:
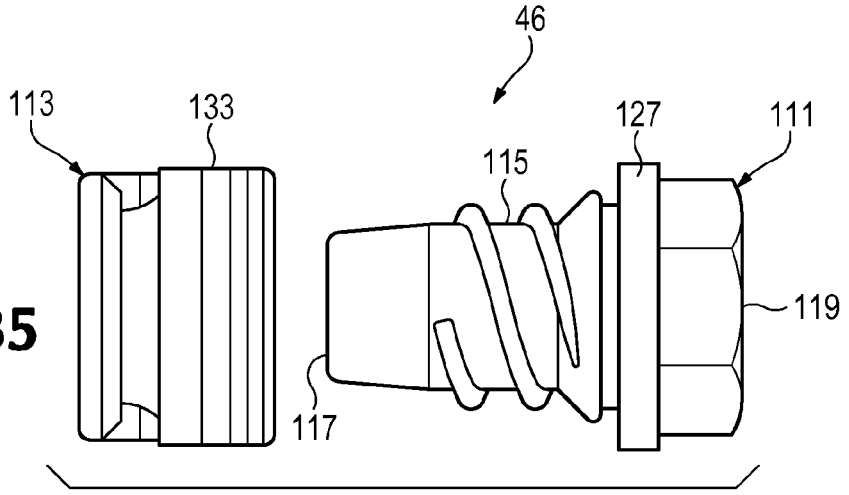
FIG. 35 is an exploded top view of the retainer.
Figure 36:
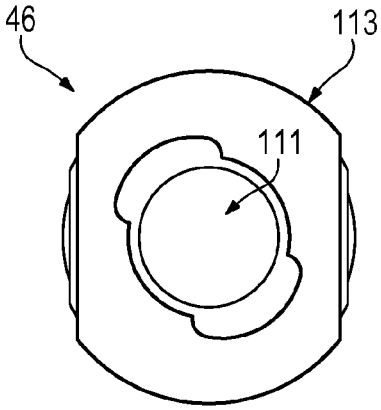
FIG. 36 is a front view of the retainer.
Figure 37:
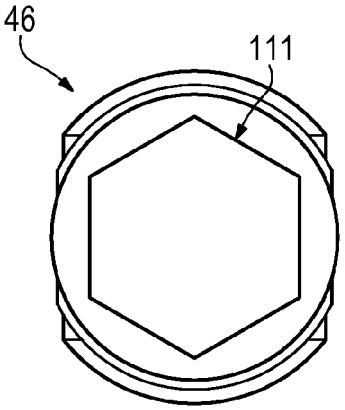
FIG. 37 is a rear view of the retainer.
Figure 38:
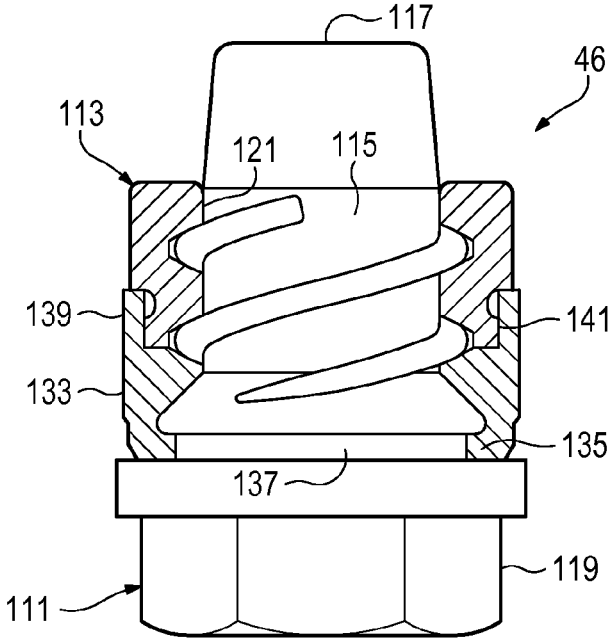
FIG. 38 is a sectional view of the retainer.

A wear indicator 143 preferably formed as a cavity extension forward of cavity 78 is provided to identify when the wear cap is spent and should be replaced (FIGS. 3 and 31). When wear cap 40 is to be replaced, screw 111 is retracted or removed so that free end 117 is moved out of hole 74. Wear cap 40 can then be pulled from seat 44. If embedded fines cause wear cap 40 to stick to seat 44, wear cap 40 can be pried forward from seat 44 with a standard pry tool (not shown). However, since there is ordinarily no need to pull the base 37 from holder 13 (i.e., unless it was also worn and needing to be replaced), the replacement process is much quicker and easier as compared to conventional tips. Additionally, one or more depressions 145 are preferably provided at the rear end of seat 44 to accommodate the insertion of the pry tool between base 37 and holder 13 to facilitate removal of the base from the holder when the holder needs to be replaced.

Figure 39:
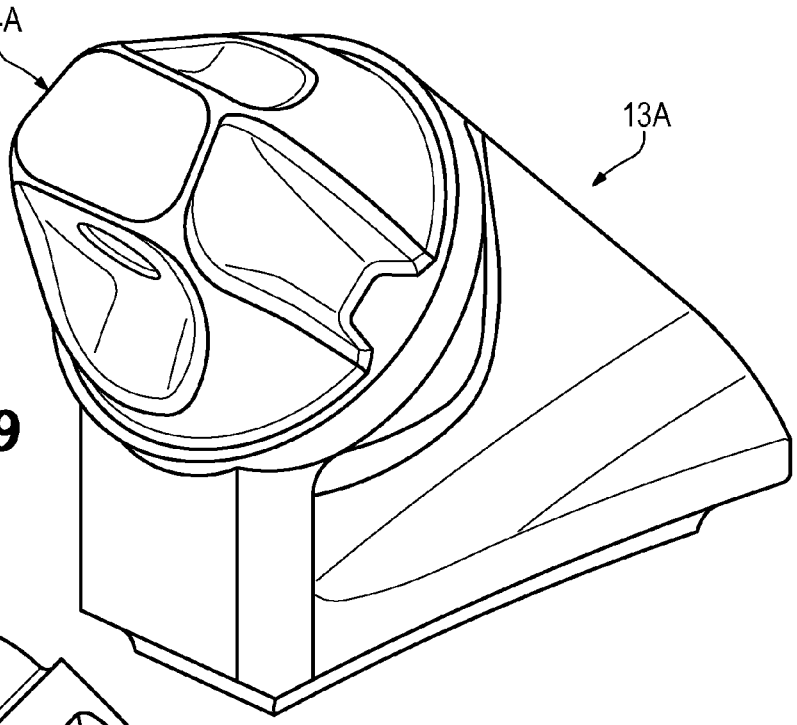
FIG. 39 is a perspective view of an alternative holder.
Figure 40:
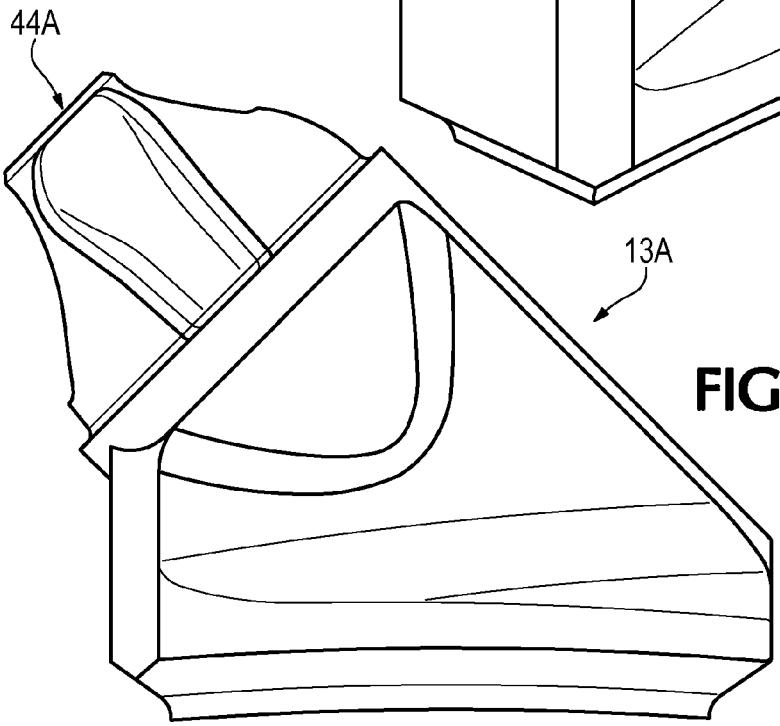
FIG. 40 is a side view of the alternative holder.
Figure 41:
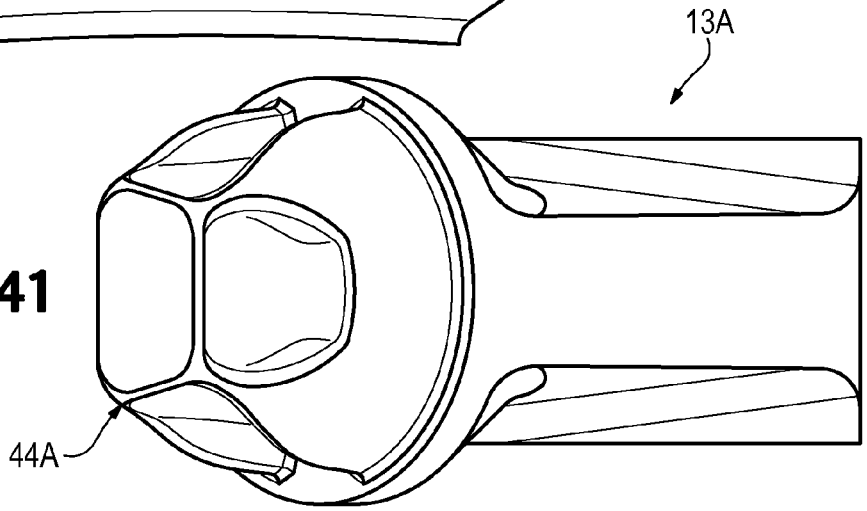
FIG. 41 is a top view of the alternative holder.
Figure 42:
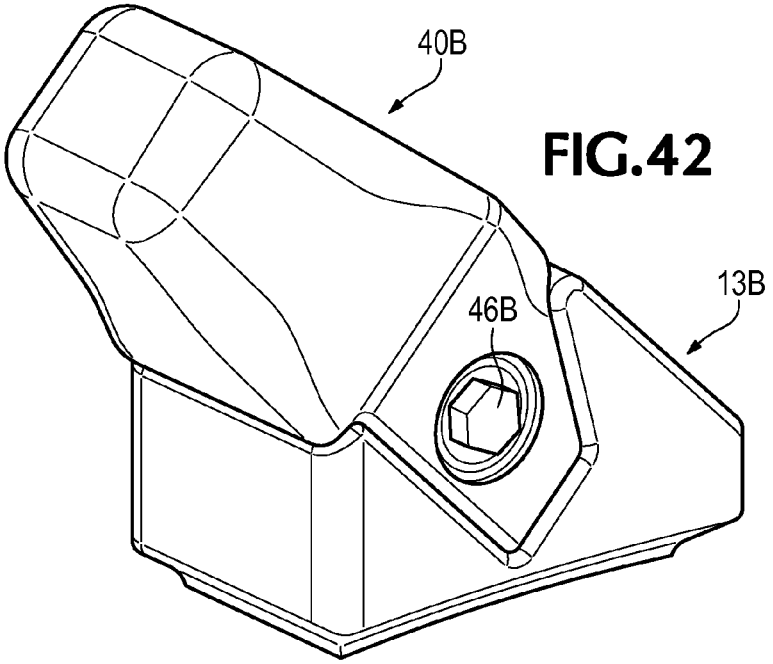
FIG. 42 is a perspective view of a second alternative holder and an alternative wear cap.
Figure 43:
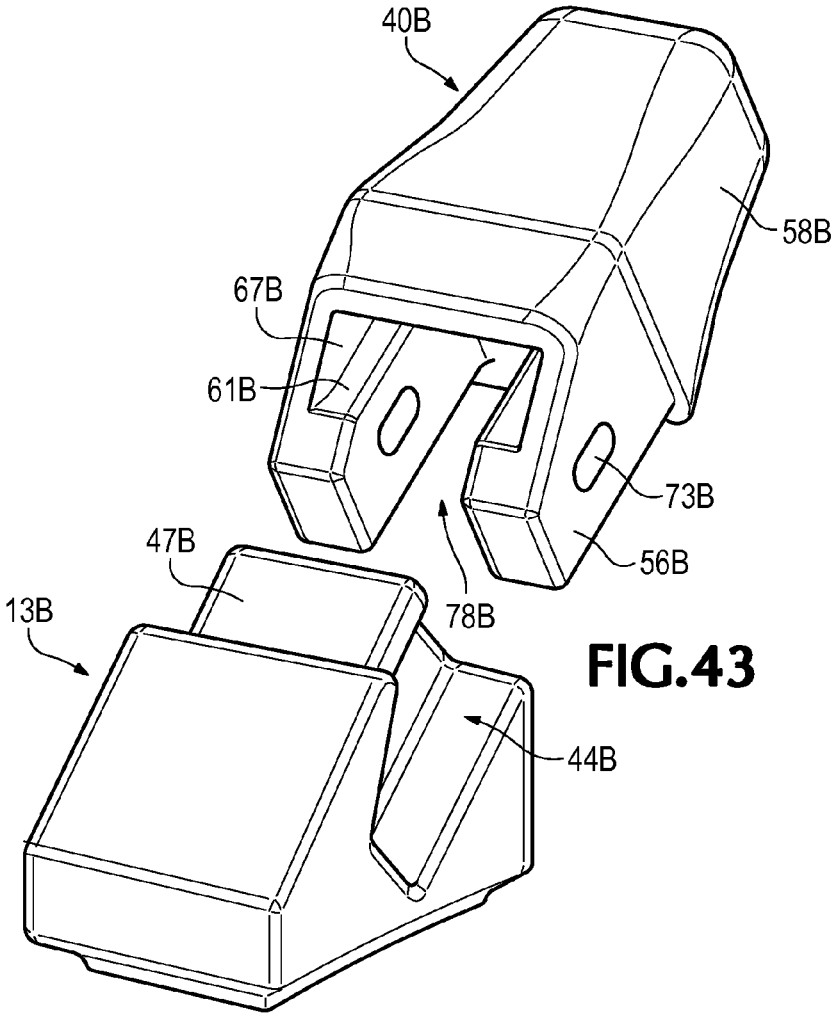
FIG. 43 is an exploded, perspective view of the second alternative holder and alternative wear cap.
Figure 44:
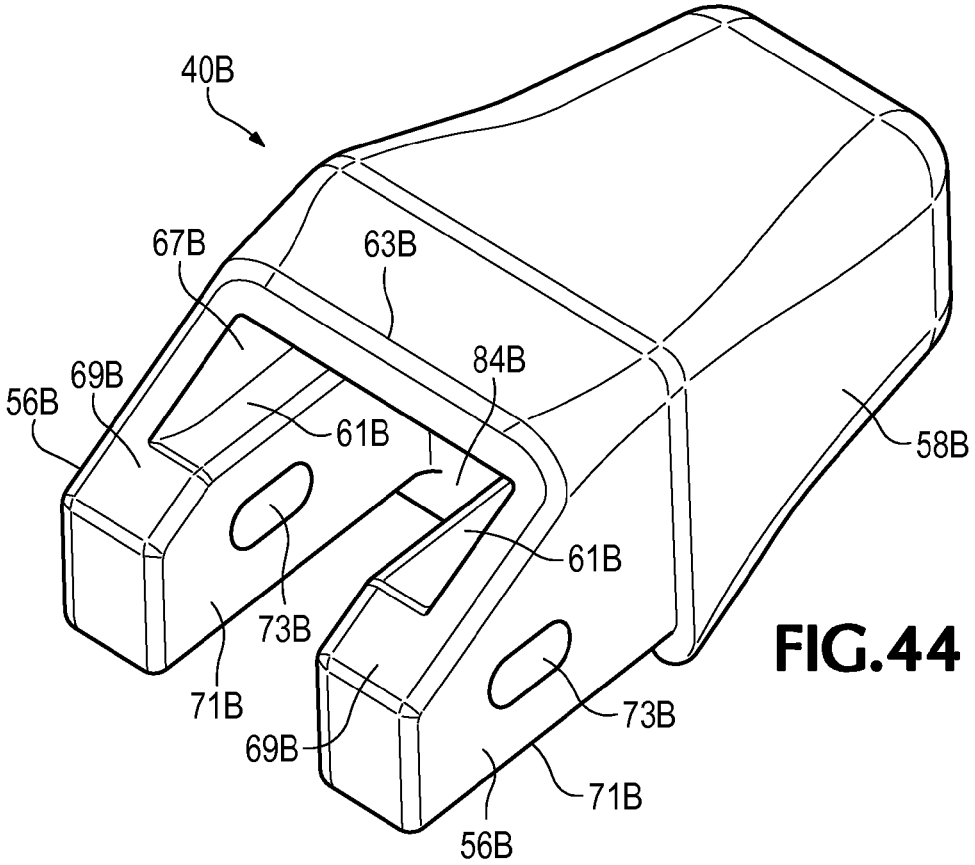
FIG. 44 is a perspective view of the alternative wear cap.
Figure 45:
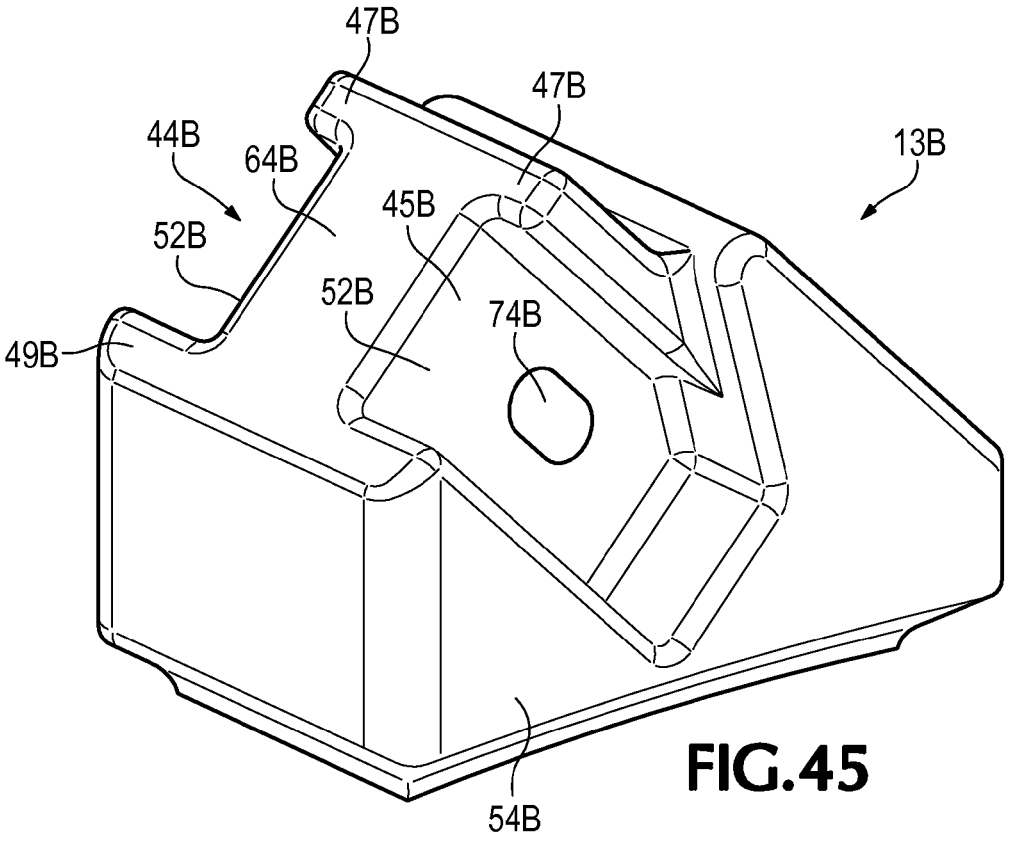
FIG. 45 is a perspective view of the second alternative holder.
Figure 46:
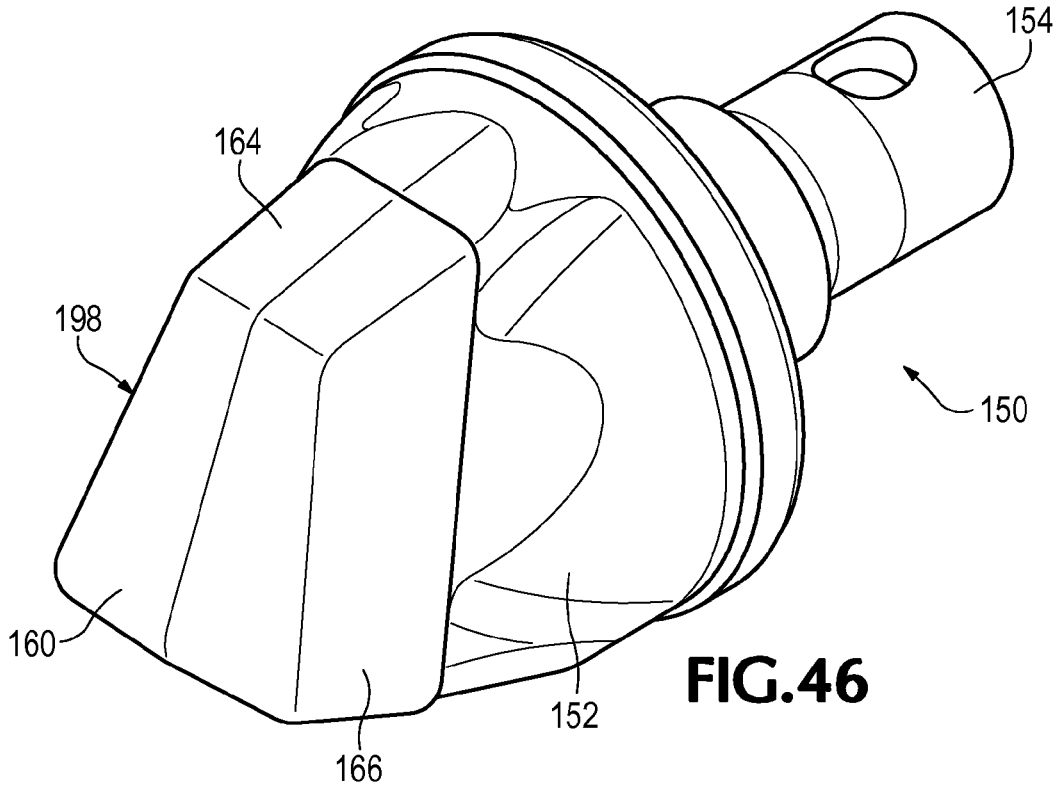
FIG. 46 is a perspective view of another alternative tip in accordance with the present invention.
Figure 47:
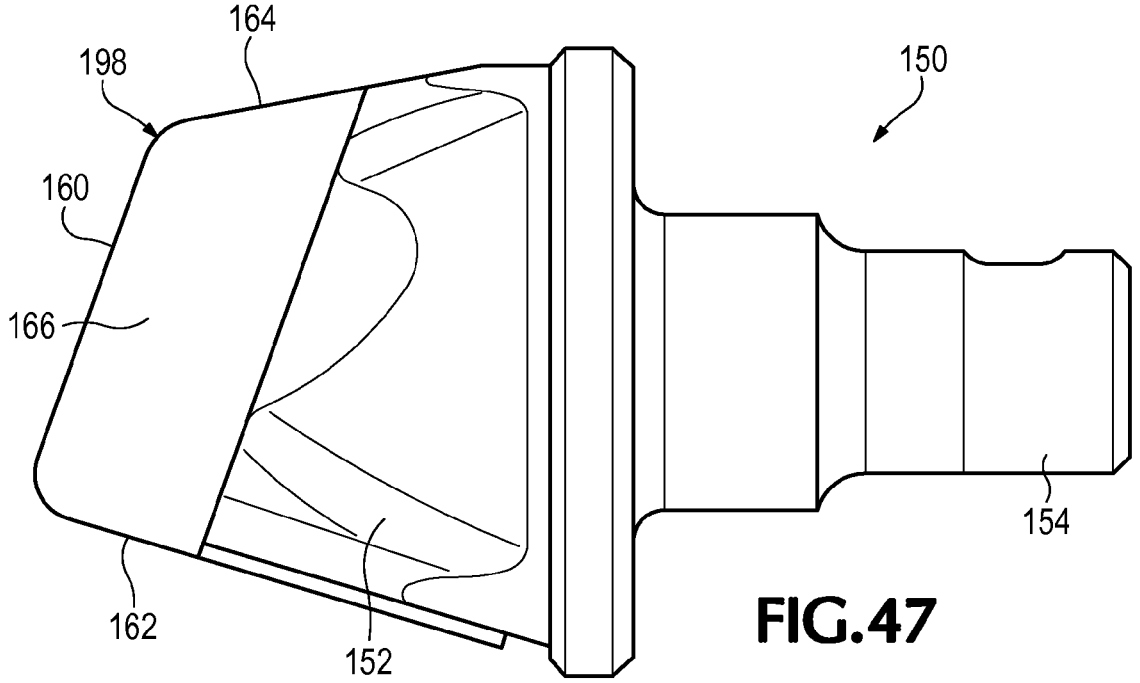
FIG. 47 is a side view of the alternative tip of FIG. 46.
Figure 48:
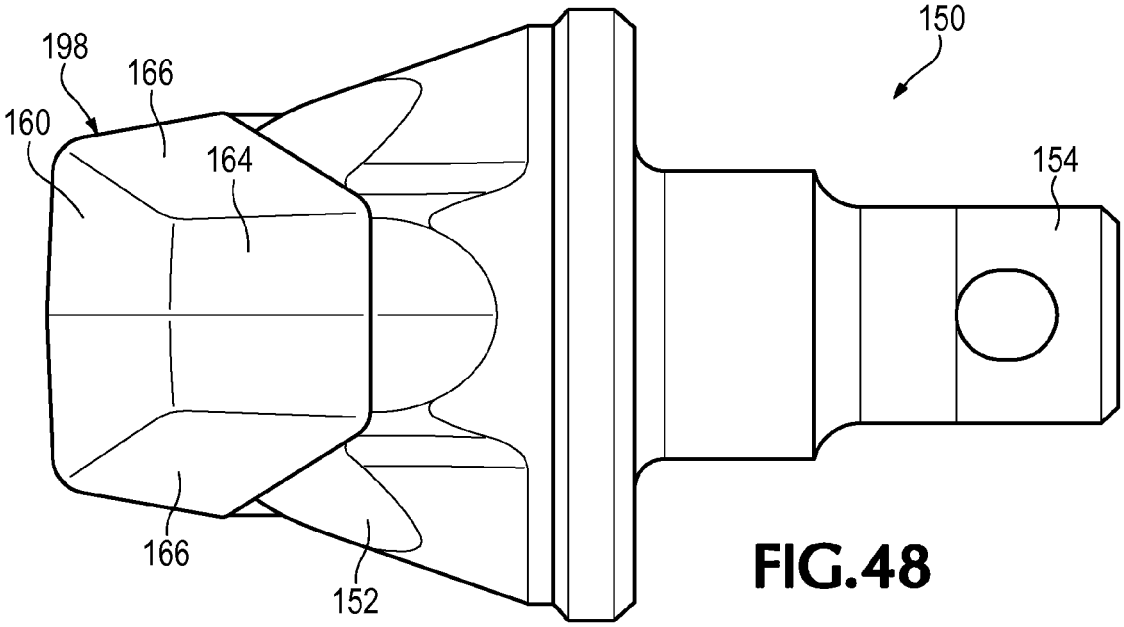
FIG. 48 is a top view of the alternative tip of FIG. 46.
Figure 49:
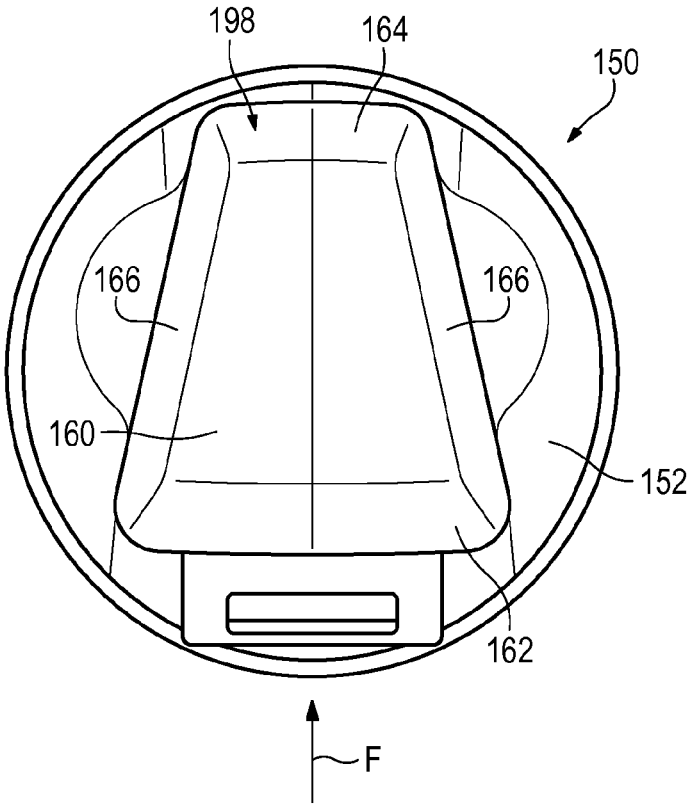
FIG. 49 is a front view of the alternative tip of FIG. 46.

In an alternative embodiment, the tip is defined by a wear cap 40 alone, i.e., without a base received into the holder. In this embodiment, holder 13A includes a seat 44A upon which wear cap 40 is attached (FIGS. 39-41). Seat 44A preferably has the same construction as seat 44 on base 37 though other arrangements could be used. Preferably, wear cap 40 and retainer 46 have the same construction as when used with base 37. The only difference is that base 37 is eliminated and seat 44A is integral with holder 13A.

Nevertheless, other holders and wear caps could be used. As one other example, an alternative embodiment is illustrated in FIGS. 42-45. In this embodiment, holder 13B includes a seat 44B that is defined by a generally l shaped formation having a central stem 45B, upper and lower supports 478, 49B, and side recesses 52B. Upper support 47B is preferably a flange that extends laterally from each side of stem 45B. Lower support 498 is preferably formed as a bearing surface of the holder base 54B. A hole 74B extends into or through stem 45B for receiving a retainer 46B to hold a wear cap 40B to holder 13B.

Wear cap 40B includes a rearward facing or opening cavity 78B for receiving seat 44B. In this embodiment, cavity 78B has a generally T shaped configuration in transverse section. A pair of arms 56B extends rearward from working end 58B to define side rails 61B that fit into recesses 52B on seat 44B. Each rail 61B is spaced from an upper wall 63B to define an upper groove 67B adapted to receive upper support 47B. A front surface 84B of cavity 78B is adapted to abut front face 64B of seat 44B. The upper and lower surfaces 69B, 71B of arms 56B are adapted to bear against the upper and lower supports 47B, 49B, respectively. Upper surface 69B is preferably inclined downward relative to the longitudinal axis to keep a low profile with holder 13B. A hole 73B extends through one or each arm 56B and generally aligns with hole 74B in holder 13B for receiving retainer 46B.

Once wear cap 40B is mounted on seat 44B, a retainer 46B is inserted to hold the wear cap to the seat. Retainer 46B is preferably of the same design as retainer 46 but could have other constructions.

In another embodiment of the invention (FIGS. 46-49), tip 150 is a one-piece member that includes a front working end or portion 152 to engage the earthen material 1, and a rear mounting end or portion 154 to secure the tip to a roll via a mount or base. Tip 150 preferably has essentially the same exterior configuration except for the features related to retainer 46. The working end 152 of tip 150 has a front surface 160, a leading surface 162, a trailing surface 164 and a pair of side surfaces 166 extending between surfaces 162, 164. The working end 152 has the same exterior configuration as wear cap 40. Mounting end 154 has the same configuration as shaft 42. Accordingly, the working end is preferably formed with side relief along front portion 198 to reduce wear and drag on the tip so that the usable life of the tip is lengthened and less power is needed to drive the roll. As with wear cap 40, side relief is provided by forming the side surfaces 166 to be predominantly within the width or lateral sides of the leading surface 162.

Although preferred embodiments are described above for a two piece tip, a one piece wear cap tip, and a one piece tip with a working end and a mounting end, other arrangements in accordance with the invention are possible. Different aspects of the invention can be used in isolation to achieve some of the benefits of the invention. For example, a wide variety of different configurations could be used to form the cavity, the seat, the external wear surface, or the retainer and still achieve the benefits of discarding less material when the working end is worn out and provide an easier tip replacement process. The wear cap could even have a cone shaped exterior and part of a tip that is subject to rotation as with the cone of a conventional tip. Further, the front surface of the tip could be curved, pointed or have shapes and/or orientations other than planar and inclined to the longitudinal axis. The working end of the tip may also be provided with a carbide or hard material front surface, or with embedded carbide, ceramic or other wear resistant members, or with other wear resistant means besides hardfacing.

Figure 50:
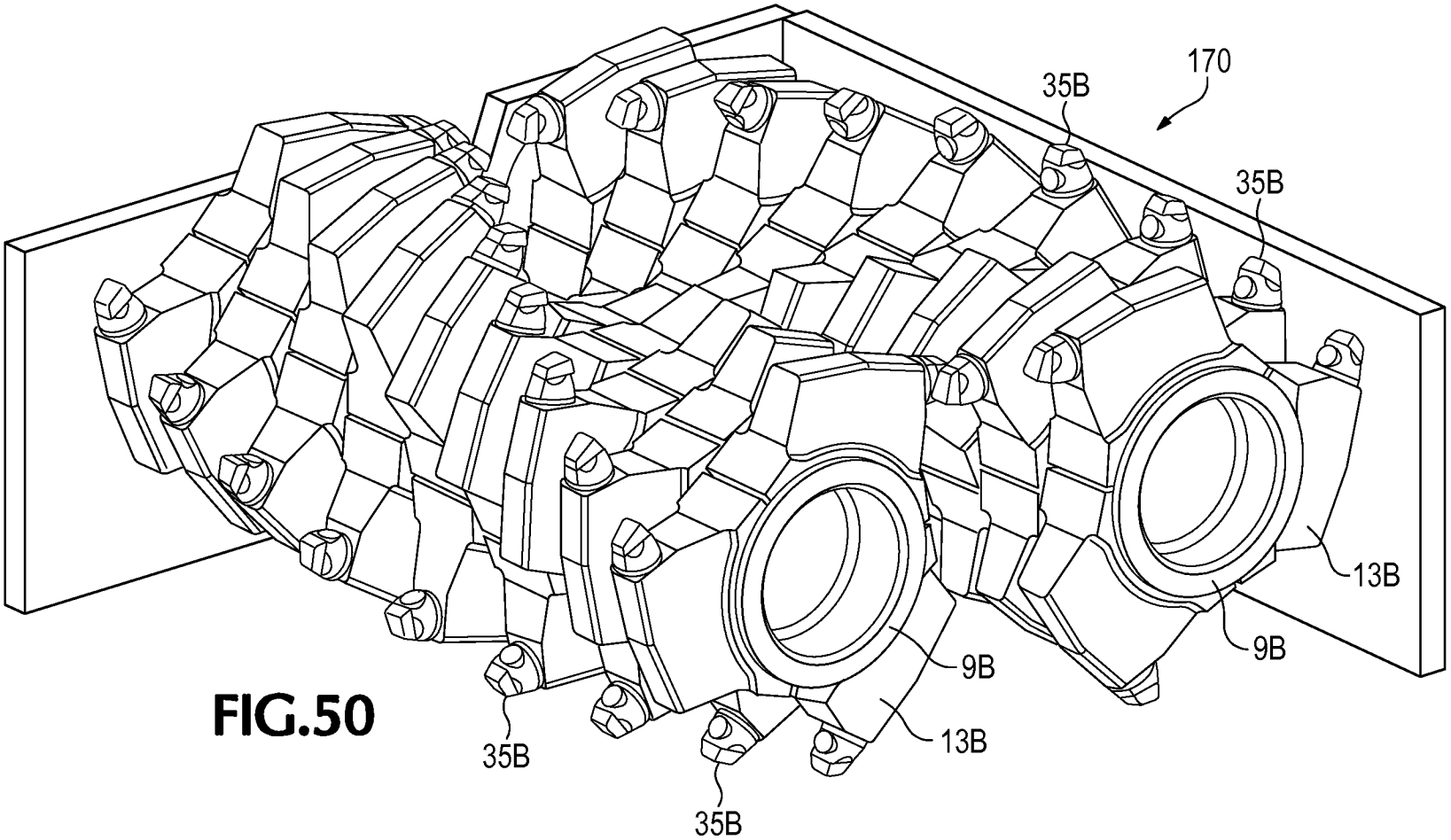
FIG. 50 is a partial perspective view of a scroll crusher with tips in accordance with the present invention.
Figure 51:
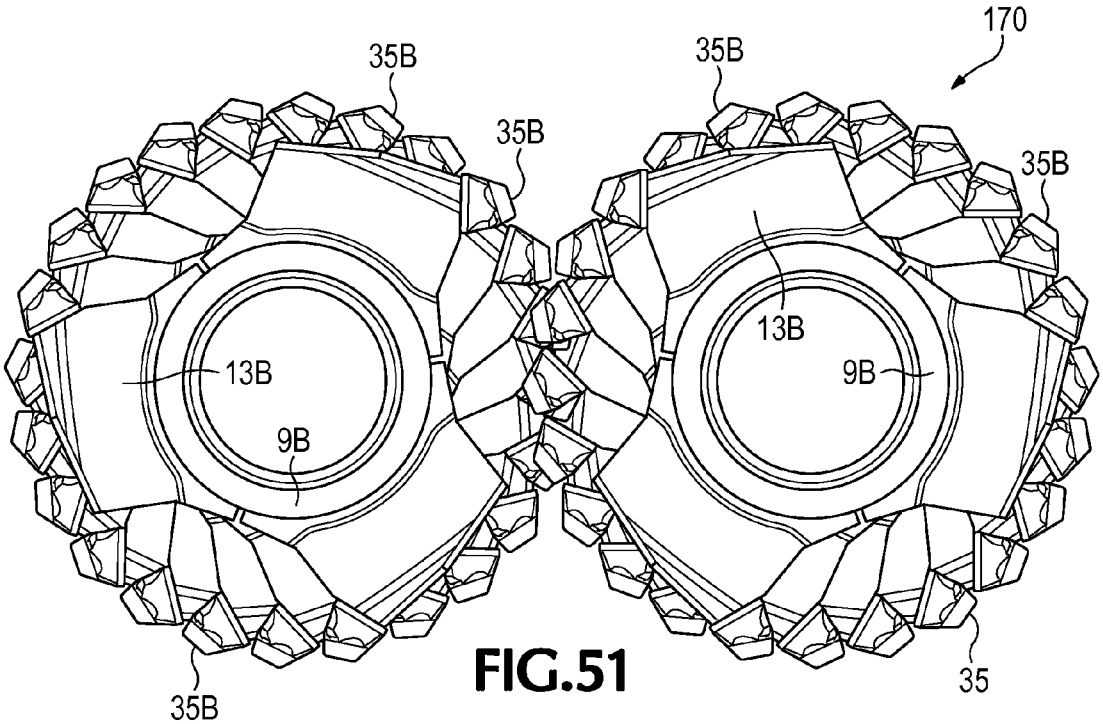
FIG. 51 is an end view of the two rollers in the scroll crusher.
Figure 52:
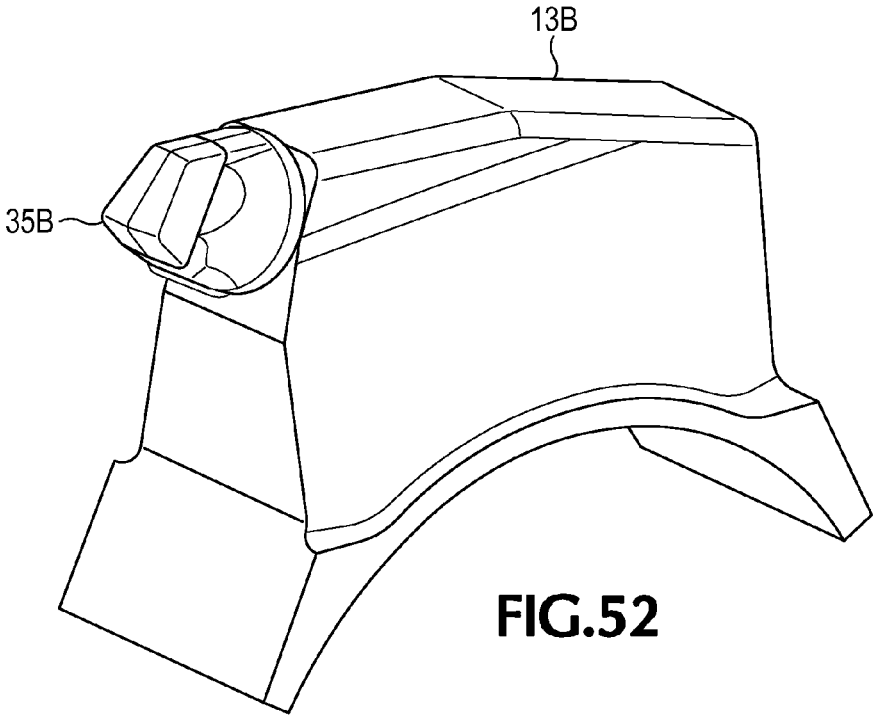
FIG. 52 is a perspective view of a tip in accordance with the present invention in a holder for the scroll crusher.
Figure 53:
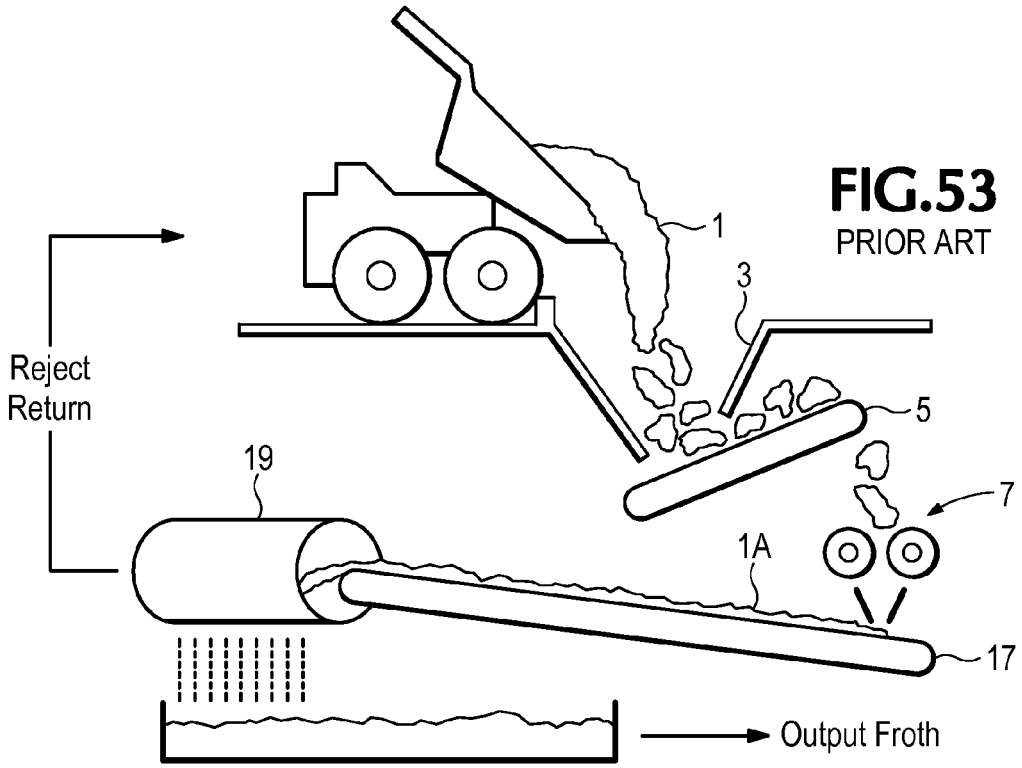
FIG.53 PRIOR ART
FIG. 53 is a schematic illustration of a mining operation with a double roll crusher.
Figure 54:
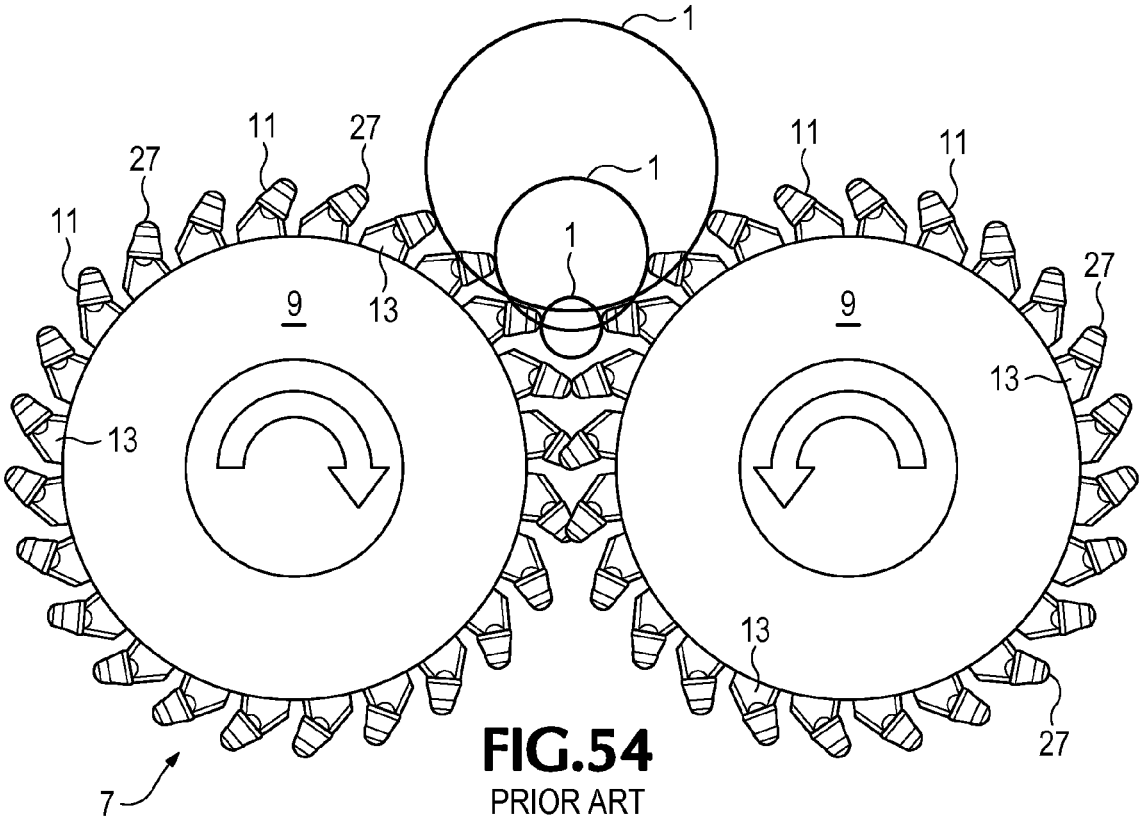
FIG.54 PRIOR ART
FIG. 54 is a schematic illustration of the operation of the rolls in a double roll crusher.
Figure 55:
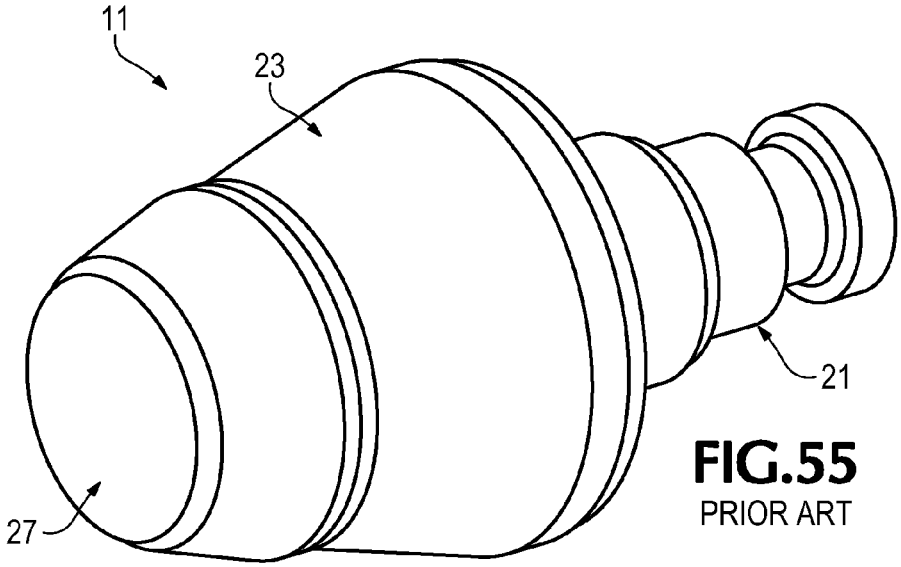
FIG.55 PRIOR ART
FIG. 55 is a perspective view of a conventional tip.
Figure 56:
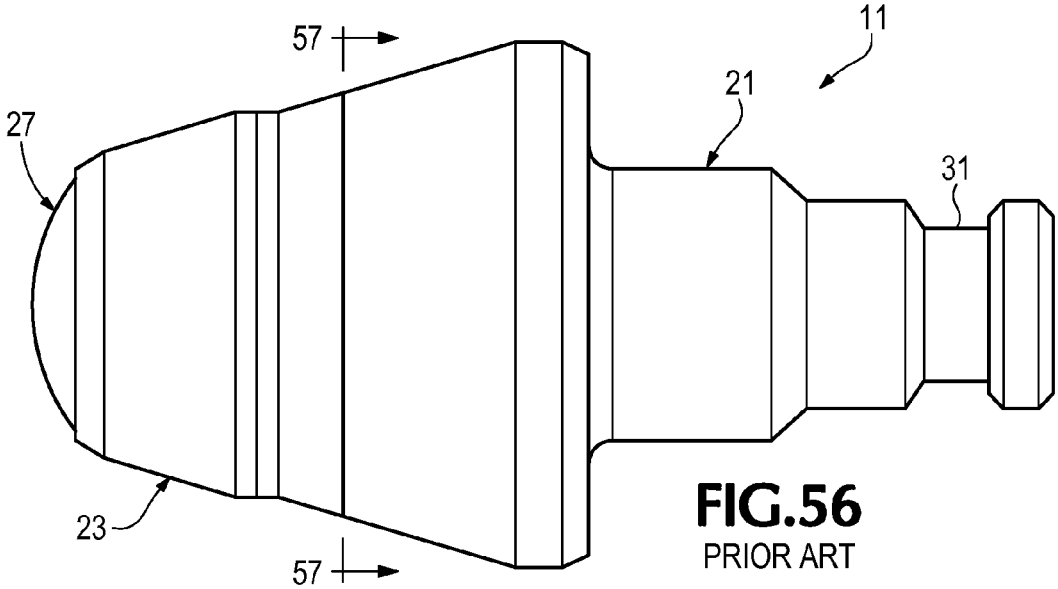
FIG.56 PRIOR ART
FIG. 56 is a side view of the conventional tip.
Figure 57:
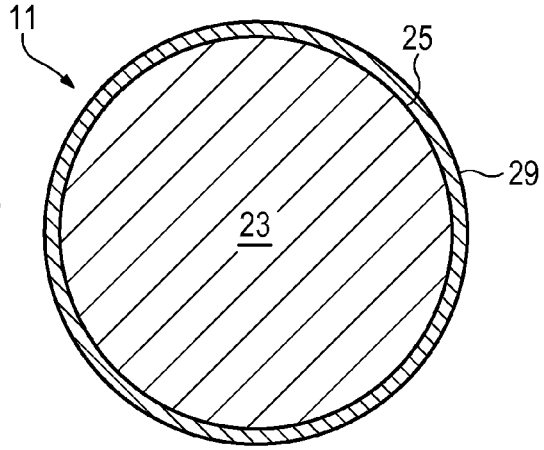
FIG.57 PRIOR ART
FIG. 57 is a cross sectional view of the conventional tip taken along line 57-57 in FIG. 56.

Although the application primarily discloses the use of tips in accordance with the present invention in conjunction with a double roll crusher, such tips could be used in other machines including, for example a scroll crusher 170 (FIGS. 50-52). In a scroll crusher operation, tips 35 are attached to holders 13B that are secured to rolls 9B.

The invention claimed is:

1. A tip for attachment to a driven roll in an earth working machine, the tip comprising:

a base having a forward facing seat and a mounting end, the mounting end being releasably attached to the roll, the base including a hole, and the seat including (i) a pair of grooves or rails and (ii) a plurality of base stabilizing surfaces separate and spaced from the grooves or rails;

a wear cap separable from the base, the wear cap including:

a cavity having a longitudinal axis and opening rearward and receiving the seat and generally corresponding to the shape of the seat;

an opening that aligns with the hole in the base; and a wear surface, the wear surface having a front working portion to impact the material when the roll is driven, the front working portion including:

a leading surface facing in the direction the wear cap moves with the roll, the leading surface being inclined forwardly and inwardly at an acute angle relative to the longitudinal axis;

a trailing surface opposite the leading surface, and inclined forwardly and inwardly relative to the longitudinal axis; and a front surface inclined rearward from the leading surface in the primary direction of the flow of material and inclined to the longitudinal axis at an acute angle; where an intersection of the front surface and the leading surface defines a foremost impact corner extending transversely to the longitudinal axis for striking the earthen material; and a retainer received into the opening in the wear cap and into the hole in the base to releasable hold the wear cap to the base, wherein the cavity that receives the seat of the base includes:

at least two pairs of opposing surfaces, the at least two pairs of opposing surfaces being generally perpendicular to each other;

a rail or groove on each said surface of a first pair of the at least two pairs of opposing surfaces, the rails or grooves of the cavity extending axially through the cavity for receipt within the other of the rails or grooves on the seat of the base, the rails and grooves axially extending generally parallel to the longitudinal axis; and a plurality of cavity stabilizing surfaces separate and spaced from the rails and grooves, one of the cavity stabilizing surfaces being located on each said surface of a second pair of the at least two pairs of opposing surfaces, the cavity stabilizing surfaces being in engagement with the base stabilizing surfaces, each of the stabilizing surfaces of the cavity and the base axially extending substantially parallel to the longitudinal axis to stably support the wear cap on the base to resist loads applied to the wear cap by rotation of the driven roll.

2. A tip in accordance with claim 1 wherein the retainer is a threaded member that is threadedly received through the opening in the wear cap and releasably received into the hole in the base.

3. A tip in accordance with claim 1 in which only the front working portion of the wear cap is covered with hardfacing.

4. A tip in accordance with claim 1 wherein the front surface is inclined at an angle of about 70 degrees to a longitudinal axis of the tip.

5. A tip in accordance with claim 1 wherein the wear cap is of one piece.

6. A tip in accordance with claim 1 wherein the retainer is a threaded member that is threadedly received through the wear cap and releasably received into the base.

7. A tip in accordance with claim 1 in which the seat includes grooves and the cavity includes rails received into the grooves on the seat.

8. A tip in accordance with claim 1, wherein the stabilizing surfaces are flat.

9. A wear cap to separate an earthen material, the wear cap mounted to a base on a driven roll comprising:

a cavity having a longitudinal axis and opening rearward and receiving a seat on the base and generally corresponding to the shape of the seat;

an opening that aligns with a hole in the base to receive a retainer to hold the wear cap to the base; and a wear surface, the wear surface having a front working portion to impact the material when the roll is driven, the front working portion including:

a leading surface facing in the direction the wear cap moves with the roll, the leading surface being inclined forwardly and inwardly at an acute angle relative to the longitudinal axis;

a trailing surface opposite the leading surface, and inclined forwardly and inwardly relative to the longitudinal axis; and a front surface inclined rearward from the leading surface in the primary direction of the flow of material and inclined to the longitudinal axis at an acute angle; where an intersection of the front surface and the leading surface defines a foremost impact corner extending transversely to the longitudinal axis for striking the earthen material; and wherein the cavity that receives the seat of the base includes:

at least two pairs of opposing surfaces, the at least two pairs of opposing surfaces being generally perpendicular to each other;

a rail or groove on each said surface of a first pair of the at least two pairs of opposing surfaces, the rails or grooves of the cavity extending axially through the cavity for receipt within the other of rails or grooves on the seat of the base, the rails or grooves axially extending generally parallel to the longitudinal axis; and a plurality of stabilizing surfaces separate and spaced from the rails or grooves, the stabilizing surfaces being located on a second pair of the at least two pairs of opposing surfaces, the stabilizing surfaces in engagement with stabilizing surfaces on the base, the plurality of stabilizing surfaces axially extending substantially parallel to the longitudinal axis to stably support the wear cap on the base to resist loads applied to the wear cap by rotation of the driven roll.

10. A wear cap in accordance with claim 9 where the stabilizing surfaces are flat.

11. A wear cap in accordance with claim 9 where the wear cap is cast as one piece.

12. A wear cap in accordance with claim 9 wherein only the front working portion of the wear cap is covered with hardfacing.

13. A wear cap in accordance with claim 9 wherein the front surface is inclined at an angle of 70 degrees to the longitudinal axis of the tip.

14. A wear cap in accordance with claim 9 where the opening is threaded.

15. A wear cap in accordance with claim where the cavity includes rails received into grooves on the seat.

16. A wear cap in accordance with claim 9 where the cavity includes grooves received into rails on the seat.

17. A tip for attachment to a driven roll in an earth working-machine, the tip comprising:

a base having a forward facing seat and a mounting end, the mounting end being releasably attached to the roll, the base including a hole, and the seat including (i) a pair of grooves or rails and (ii) a plurality of base stabilizing surfaces separate and spaced from the grooves or rails;

a wear cap separable from the base, the wear cap including:

a cavity having a longitudinal axis and opening rearward and receiving the seat and generally corresponding to the shape of the seat; and an opening that aligns with the hole in the base; and a retainer received into the opening in the wear cap and into the hole in the base to releasable hold the wear cap to the base, wherein the cavity that receives the seat of the base includes:

at least two pairs of opposing surfaces, the at least two pairs of opposing surfaces being generally perpendicular to each other;

a rail or groove on each said surface of a first pair of the at least two pairs of opposing surfaces, the rails or grooves of the cavity extending axially through the cavity for receipt within the other of the rails or grooves on the seat of the base, the rails and grooves axially extending generally parallel to the longitudinal axis; and a plurality of cavity stabilizing surfaces separate and spaced from the rails and grooves, one of the cavity stabilizing surfaces being located on each said surface of a second pair of the at least two pairs of opposing surfaces, the cavity stabilizing surfaces being in engagement with the base stabilizing surfaces, each of the stabilizing surfaces of the cavity and the base axially extending substantially parallel to the longitudinal axis to stably support the wear cap on the base to resist loads applied to the wear cap by rotation of the driven roll; and a widened section rearward of the stabilizing surfaces in the cavity, the widened section being defined in part by the second pair of the at least two pairs of opposing surfaces, the surfaces of the widened section extending rearward at an angle greater than 7 degrees to the longitudinal axis.

18. A tip in accordance with claim 17 wherein the retainer is a threaded member that is threadedly received through the opening in the wear cap and releasably received into the hole in the base.

19. A tip in accordance with claim 17 in which the seat includes grooves and the cavity includes rails received into the grooves of the seat.

20. A tip in accordance with claim 17, wherein the stabilizing surfaces are flat.

21. A wear cap to separate an earthen material, the wear cap being mounted to a base on a driven roll comprising:

a cavity having a longitudinal axis and opening rearward and receiving a seat on the base and generally corresponding to the shape of the seat; and an opening that aligns with a hole in the base to receive a retainer to hold the wear cap to the base, wherein the cavity that receives the seat of the base includes:

at least two pairs of opposing surfaces, the at least two pairs of opposing surfaces being generally perpendicular to each other;

a rail or groove on each said surface of a first pair of the at least two pairs of opposing surfaces, the rails or grooves of the cavity extending axially through the cavity for receipt within the other of rails or grooves on the seat of the base, the rails or grooves of the cavity axially extending generally parallel to the longitudinal axis; and a plurality of stabilizing surfaces separate and spaced from the rails or grooves, the stabilizing surfaces being located on each said surface of a second pair of the at least two pairs of opposing surfaces, the stabilizing surfaces being in engagement with stabilizing surfaces on the base, the stabilizing surfaces of the cavity axially extending substantially parallel to the longitudinal axis to stably support the wear cap on the base to resist loads applied to the wear cap by rotation of the driven roll; and a widened section rearward of the stabilizing surfaces in the cavity, the widened section being defined in part by the second pair of the at least two pairs of opposing surfaces, the surfaces of the widening section extending rearward at an angle greater than 7 degrees to the longitudinal axis.

22. A wear cap in accordance with claim 21 wherein the opening is threaded.

23. A wear cap in accordance with claim 21 where the cavity includes the rails received into the grooves on the seat.

24. A tip in accordance with claim 21, wherein the stabilizing surfaces are flat.

* * * * *